US006457319B1

(12) United States Patent
Ota et al.

(10) Patent No.: US 6,457,319 B1
(45) Date of Patent: Oct. 1, 2002

(54) AIR CONDITIONER AND CONTROL VALVE IN VARIABLE DISPLACEMENT COMPRESSOR

(75) Inventors: Masaki Ota; Ken Suitou; Ryo Matsubara; Hirotaka Kurakake, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/717,804

(22) Filed: Nov. 21, 2000

(30) Foreign Application Priority Data

Nov. 25, 1999 (JP) ..... 11-334279

(51) Int. Cl.[7] ..... F25B 1/00; F04B 49/00
(52) U.S. Cl. ..... 62/228.3; 62/228.5; 417/43
(58) Field of Search ..... 417/43, 222, 2; 62/228.3, 228.5; 73/196, 861.42

(56) References Cited

U.S. PATENT DOCUMENTS 4,905,477 A * 3/1990 Takai ..... 62/228.5

FOREIGN PATENT DOCUMENTS

JP 406180155 * 6/1994 ..... 62/228.3
JP 11-294328 10/1999

* cited by examiner

*Primary Examiner*—William Wayner
(74) *Attorney, Agent, or Firm*—Morgan & Finnegan, LLP

(57) ABSTRACT

A control valve controls the pressure in a crank chamber of a compressor to change the displacement of the compressor. The compressor includes a discharge chamber, a suction chamber and a supply passage, which connects the discharge chamber to the crank chamber. The control valve regulates the supply passage. The control valve includes a valve body, a spool and a solenoid. The valve body adjusts the size of an opening in the supply passage. The spool moves the valve body in accordance with the difference between the pressure in the discharge chamber and the pressure in the suction chamber. The solenoid urges the valve body by a force, the magnitude of which corresponds to a supply of electricity. The urging force of the solenoid represents a target value of the pressure difference. The spool moves the valve body such that the pressure difference seeks the target value. The control valve, which is located in the compressor, permits the compressor displacement to be accurately controlled regardless of a thermal load on an evaporator.

14 Claims, 14 Drawing Sheets

AIR CONDITIONER AND CONTROL VALVE IN VARIABLE DISPLACEMENT COMPRESSOR

BACKGROUND OF THE INVENTION

The present invention relates to an air conditioner having a refrigerant circuit. More particularly, the present invention pertains to a displacement control valve used in a variable displacement compressor in a refrigerant circuit.

A typical refrigerant circuit of a vehicle air conditioner includes a condenser, an expansion valve, an evaporator and a compressor. The compressor receives refrigerant gas from the evaporator. The compressor then compresses the gas and discharges the gas to the condenser. The evaporator transfers heat to the refrigerant in the refrigerant circuit from the air in the passenger compartment. The pressure of refrigerant gas at the outlet of the evaporator, in other words, the pressure of refrigerant gas that is drawn into the compressor (suction pressure Ps), represents the thermal load on the refrigerant circuit.

Variable displacement swash plate type compressors are widely used in vehicles. Such compressors include a displacement control valve that operates to maintain the suction pressure Ps at a predetermined target level (target suction pressure). The control valve changes the inclination angle of the swash plate in accordance with the suction pressure Ps for controlling the displacement of the compressor. The control valve includes a valve body and a pressure sensing member such as a bellows or a diaphragm. The pressure sensing member moves the valve body in accordance with the suction pressure Ps, which adjusts the pressure in a crank chamber. The inclination of the swash plate is adjusted, accordingly.

In addition to the above structure, some control valves include an electromagnetic actuator, such as a solenoid, to change the target suction pressure. An electromagnetic actuator urges a pressure sensing member or a valve body in one direction by a force that corresponds to the value of an externally supplied current. The magnitude of the force determines the target suction pressure. Varying the target suction pressure permits the air conditioning to be finely controlled.

Such compressors are usually driven by vehicle engines. Among the auxiliary devices of a vehicle, the compressor consumes the most engine power and is therefore a great load on the engine. When the load on the engine is great, for example, when the vehicle is accelerating or moving uphill, all available engine power needs to be used for moving the vehicle. Under such conditions, to reduce the engine load, the compressor displacement is minimized. This will be referred to as a displacement limiting control procedure. A compressor having a control valve that changes a target suction pressure raises the target suction pressure when executing the displacement limiting control procedure. Then, the compressor displacement is decreased such that the actual suction pressure Ps is increased to approach the target suction pressure.

The graph of FIG. 17 illustrates the relationship between suction pressure Ps and displacement Vc of a compressor. The relationship is represented by multiple lines in accordance with the thermal load in an evaporator. Thus, if the suction pressure Ps is constant, the compressor displacement Vc increases as the thermal load increases. If a level Ps1 is set as a target suction pressure, the actual displacement Vc varies in a certain range (ΔVc in FIG. 17) due to the thermal load. If a high thermal load is applied to the evaporator during the displacement limiting control procedure, an increase of the target suction pressure does not lower the compressor displacement Vc to a level that sufficiently reduces the engine load.

Thus, the compressor displacement is not always controlled as desired as long as the displacement is controlled based on the suction pressure Ps.

SUMMARY OF THE INVENTION

Accordingly, it is an objective of the present invention to provide an air conditioner and a control valve used in a variable displacement compressor that accurately control the compressor displacement regardless of the thermal load on an evaporator.

To achieve the above objective, the present invention provides an air conditioner including a refrigerant circuit. The refrigerant circuit has a condenser, a decompression device, an evaporator and a variable displacement compressor. The compressor has a discharge pressure zone, the pressure of which is a discharge pressure, and a suction pressure zone, the pressure of which is a suction pressure. The refrigerant circuit further has a high pressure passage extending from the discharge pressure zone to the condenser and a low pressure passage extending from the evaporator to the suction pressure zone. A displacement control mechanism controls the displacement of the compressor based on the pressure difference between the pressure at a first pressure monitoring point located in the refrigerant circuit and the pressure at a second pressure monitoring point located in the refrigerant circuit. The first pressure monitoring point is located in a section of the refrigerant circuit that includes the discharge pressure zone, the condenser and the high pressure passage. The second pressure monitoring point is located in a section of the refrigerant circuit that includes the evaporator, the suction pressure zone and the low pressure passage.

The present invention also provides a control valve for controlling the pressure in a crank chamber of a compressor to change the displacement of the compressor. The compressor has a discharge pressure zone, the pressure of which is a discharge pressure, a suction pressure zone, the pressure of which is a suction pressure, and an internal gas passage that includes the discharge pressure zone, the crank chamber and the suction pressure zone. The control valve comprises a valve housing, a valve body, a pressure receiver and an actuator. The valve body is located in the valve housing to adjust the size of an opening in the internal gas passage. The pressure receiver actuates the valve body in accordance with the pressure difference between the discharge pressure and the suction pressure thereby causing the pressure difference to seek a predetermined target value. The actuator urges the valve body by a force, the magnitude of which corresponds to an external command. The urging force of the actuator represents the target value of the pressure difference.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 10(*b*) is a timing chart showing changes of a discharge pressure Pd and a suction pressure Ps during the exceptional control procedure;

FIG. 10(*c*) is a timing chart showing changes the compressor torque during the exceptional control procedure;

FIG. 15(*b*) is a timing chart showing changes of a discharge pressure Pd and a suction pressure Ps during the exceptional control procedure;

FIG. 15(*c*) is a timing chart showing changes the compressor torque during the exceptional control procedure;

DETAILED DESCRIPTION OF THE PREFERRED EMBODIMENTS

Figure 1:
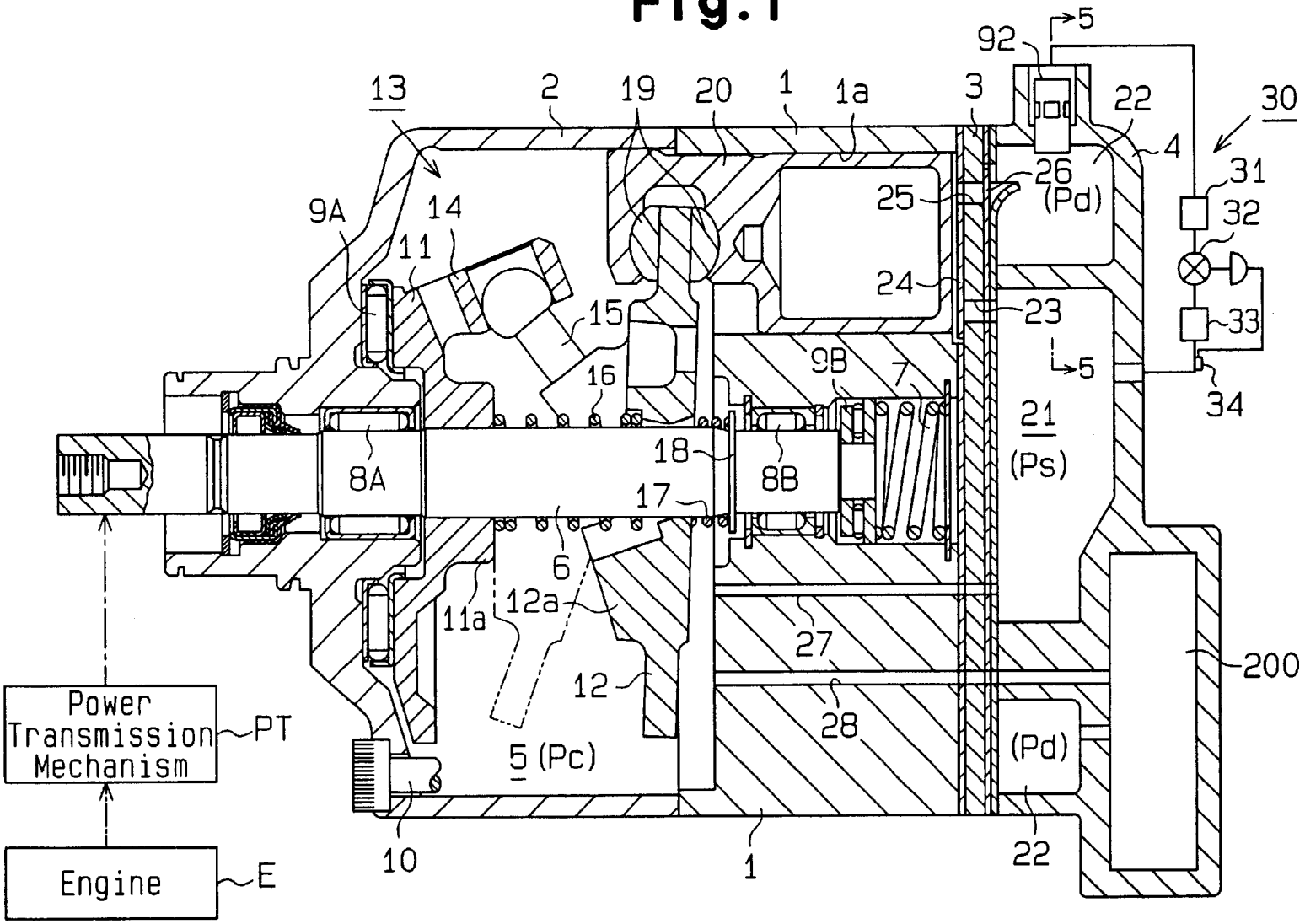
FIG. 1 is a cross-sectional view illustrating a variable displacement swash plate type compressor according to a first embodiment of the present invention.

A first embodiment of the present invention will now be described with reference to FIGS. 1 to 10(*c*). As shown in FIG. 1, a variable displacement swash plate type compressor used in a vehicle includes a cylinder block 1, a front housing member 2, which is secured to the front end face of the cylinder block 1, and a rear housing member 4, which is secured to the rear end face of the cylinder block 1. A valve plate assembly 3 is located between the cylinder block 1 and the rear housing member 4. The cylinder block 1, the front housing member 2, the valve plate assembly 3 and the rear housing member 4 are secured to one another by bolts 10 (only one is shown) to form the compressor housing. In FIG. 1, the left end of the compressor is defined as the front end, and the right end of the compressor is defined as the rear end.

A crank chamber 5 is defined between the cylinder block 1 and the front housing member 2. A drive shaft 6 extends through the crank chamber 5 and is supported through radial bearings 8A, 8B by the cylinder block 1 and a front housing member 2.

A recess is formed in the center of the cylinder block 1. A spring 7 and a rear thrust bearing 9B are located in the recess. The spring 7 urges the drive shaft 6 forward (to the left as viewed in FIG. 1) through the thrust bearing 9B. A lug plate 11 is secured to the drive shaft 6 in the crank chamber 5. A front thrust bearing 9A is located between the lug plate 11 and the inner wall of the front housing member 2.

The front end of the drive shaft 6 is connected to an external drive source, which is an engine E in this embodiment, through a power transmission mechanism PT. The power transmission mechanism PT includes a belt and a pulley. The mechanism PT may be a clutch mechanism, such as an electromagnetic clutch, which is electrically controlled from the outside. In this embodiment, the mechanism PT has no clutch mechanism. Thus, when the engine E is running, the compressor is driven continuously.

A drive plate, which is a swash plate 12 in this embodiment, is accommodated in the crank chamber 5. The swash plate 12 has a hole formed in the center. The drive shaft 6 extends through the hole in the swash plate 12. The swash plate 12 is coupled to the lug plate 11 by a hinge mechanism 13. The hinge mechanism 13 includes two support arms 14 (only one is shown) and two guide pins 15 (only one is shown) . Each support arm 14 has a guide hole and projects from the rear side of the lug plate 11. Each guide pin 15 projects from the swash plate 12. The guide hole of each support arm 14 receives the corresponding guide pin 15. The hinge mechanism 13 permits the swash plate 12 to rotate integrally with the lug plate 11 and drive shaft 6. The hinge mechanism 13 also permits the swash plate 12 to slide along the drive shaft 6 and to tilt with respect to a plane perpendicular to the axis of the drive shaft 6. The swash plate 12 has a counterweight 12*a*, which is angularly spaced by 180 degrees from the hinge mechanism 13.

A spring 16 is located between the lug plate 11 and the swash plate 12. The spring 16 urges the swash plate 12 toward the cylinder block 1. A stopper ring 18 is fixed on the drive shaft 6 behind the swash plate 12. A spring 17 is fitted about the drive shaft 6 between the stopper ring 18 and the swash plate 12. When the swash plate 12 is at the maximum inclination angle position shown by the broken line in FIG. 1, the spring 17 does not apply force to the swash plate 12. However, as the swash plate 12 is moved toward the minimum inclination angle position shown by the solid line in FIG. 1, the force of the spring 17 increases. The spring 17 is not fully contracted when the swash plate 12 is inclined by the minimum inclination angle (for example, an angle from one to five degrees).

Several cylinder bores 1*a* (only one shown) are formed about the axis of the drive shaft 6 in the cylinder block 1. A single headed piston 20 is accommodated in each cylinder bore 1*a*. Each piston 20 and the corresponding cylinder bore 1*a* define a compression chamber. Each piston 20 is coupled to the swash plate 12 by a pair of shoes 19. The swash plate 12 coverts rotation of the drive shaft 6 into reciprocation of each piston 20.

A suction chamber 21 and a discharge chamber 22 are defined between the valve plate assembly 3 and the rear housing member 4. The suction chamber 21 forms a suction pressure zone, the pressure of which is a suction pressure Ps.

The discharge chamber 22 forms a discharge pressure zone, the pressure of which is a discharge pressure Pd. The valve plate assembly 3 has suction ports 23, suction valve flaps 24, discharge ports 25 and discharge valve flaps 26. Each set of the suction port 23, the suction valve flap 24, the discharge port 25 and the discharge valve flap 26 corresponds to one of the cylinder bores 1*a*. When each piston 20 moves from the top dead center position to the bottom dead center position, refrigerant gas in the suction chamber 21 flows into the corresponding cylinder bore 1*a* via the corresponding suction port 23 and suction valve 24. When each piston 20 moves from the bottom dead center position to the top dead center position, refrigerant gas in the corresponding cylinder bore 1*a* is compressed to a predetermined pressure and is discharged to the discharge chamber 22 via the corresponding discharge port 25 and discharge valve 26.

The inclination angle of the swash plate 12 is determined according to various moments acting on the swash plate 12. The moments include a rotational moment, which is based on the centrifugal force of the rotating swash plate 12, a spring force moment, which is based on the force of the springs 16 and 17, a moment of inertia of the piston reciprocation, and a gas pressure moment, which is based on pressures in the compressor. The gas pressure moment is generated by the force of the pressure in the cylinder bores 1*a* and the pressure in the crank chamber 5 (crank pressure Pc). In this embodiment, the crank pressure Pc is adjusted by a crank pressure control mechanism, which will be discussed below. Accordingly, the inclination angle of the swash plate 12 is adjusted to an angle between the maximum inclination and the minimum inclination. The inclination angle of the swash plate 12 defines the stroke of each piston 20 and the displacement of the compressor.

The contact between the counterweight 12*a* and a stopper 11*a* of the lug plate 11 prevents further inclination of the swash plate 12 from the maximum inclination angle. The minimum inclination angle is determined based primarily on the forces of the springs 16 and 17.

Figure 2:
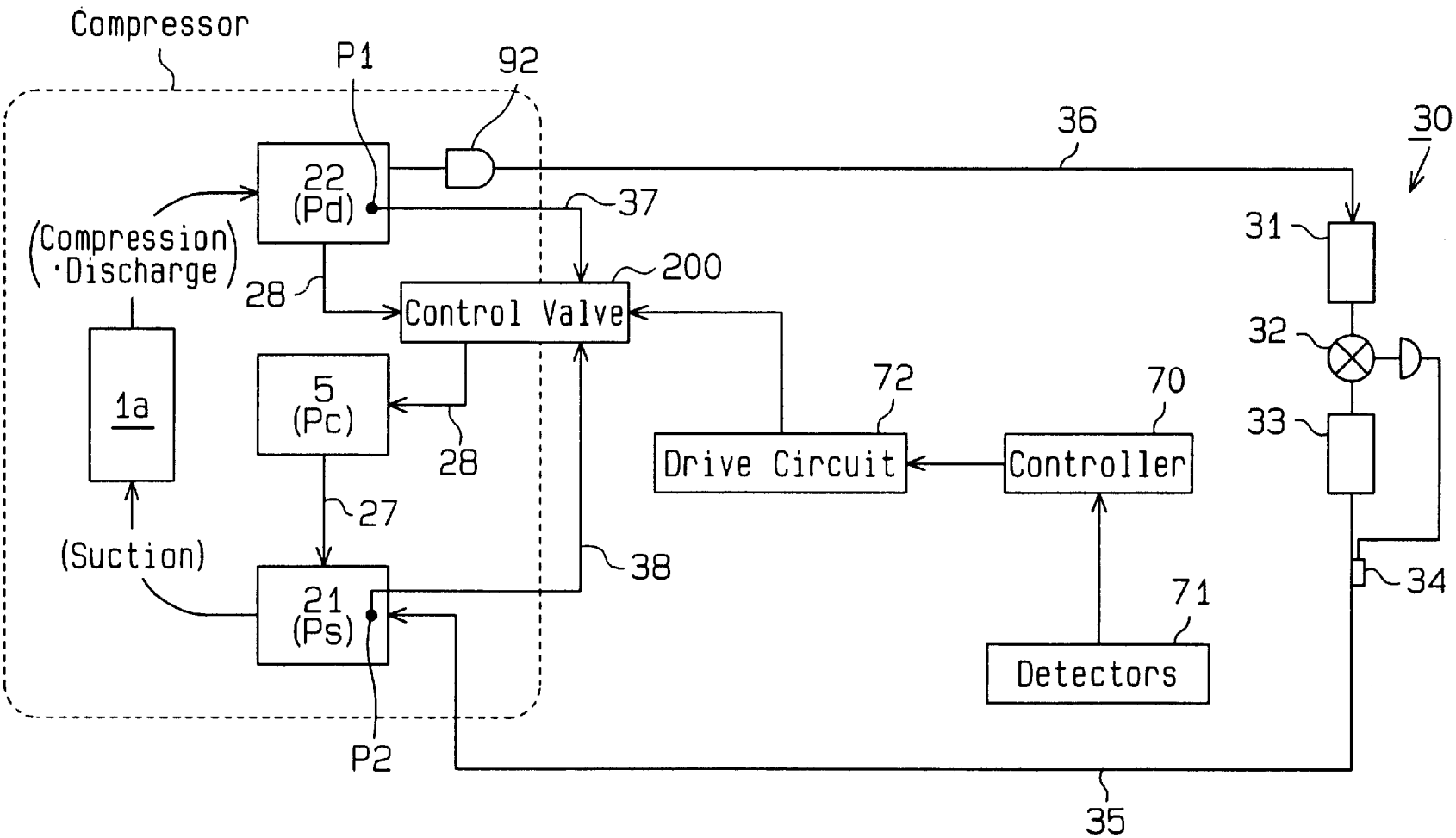
FIG. 2 is a schematic diagram illustrating a refrigerant circuit including the compressor of FIG. 1.

The crank pressure control mechanism is located in the compressor to regulate the crank pressure Pc. As shown in FIGS. 1 and 2, the mechanism includes a bleed passage 27, a supply passage 28 and a control valve 200. The bleed passage 27 connects the crank chamber 5 with the suction chamber 21 to conduct refrigerant gas from the crank chamber 5 to the suction chamber 21. The supply passage 28 connects the discharge chamber 22 with the crank chamber 5 to conduct refrigerant gas from the discharge chamber 22 to the crank chamber 5. The control valve 200 is located in the supply passage 28. The control valve 200 adjusts the flow rate of refrigerant gas supplied from the discharge chamber 22 to the crank chamber 5 through the supply passage 28 to control the crank pressure Pc. The bleed passage 27 and the supply passage 28 form an internal gas passage for circulating refrigerant gas in the compressor.

As shown in FIGS. 1 and 2, the refrigerant circuit of the vehicle air conditioner includes the compressor and an external circuit 30, which is connected to the compressor. The external circuit 30 includes a condenser 31, a decompression device and an evaporator 33. The decompression device, which is a temperature-type expansion valve 32, adjusts the flow rate of refrigerant supplied to the evaporator 33 based on the temperature or the pressure detected by a heat sensitive tube 34, which is located downstream of the evaporator 33. The temperature or the pressure at the downstream of the evaporator 33 represents the thermal load on the evaporator 32. The external circuit 30 includes a low pressure pipe 35, which extends from the evaporator 33 to the suction chamber 21 of the compressor, and a high pressure pipe 36, which extends from the discharge chamber 22 of the compressor to the condenser 31.

The difference between the discharge pressure Pd and the suction pressure Ps corresponds to the flow rate of refrigerant in the refrigerant circuit. That is, the pressure difference increases as the flow rate increases. In this embodiment, a first pressure monitoring point P1 is located in the discharge chamber 22, which is the most upstream section of the high pressure pipe 36. A second pressure monitoring point P2 is located in the suction chamber 21, which is the most downstream section of the low pressure pipe 35. In other words, the first pressure monitoring point P1 is defined in the discharge pressure zone, which is a high pressure zone in the compressor, and the second pressure monitoring pint P2 is defined in the suction pressure zone, which is the low pressure zone in the compressor. Detecting the difference (Pd−Ps) between the refrigerant gas pressure at the first monitoring point P1 (the discharge pressure Pd) and the refrigerant gas pressure at the second monitoring point P2 (the suction pressure Ps) permits the flow rate of refrigerant in the refrigerant circuit, or the compressor displacement, to be indirectly detected. The control valve 200 uses the pressure difference (Pd−Ps) as a parameter for controlling the compressor displacement.

The first pressure monitoring point P1 need not be located in the discharge chamber 22 but may be at any location where the pressure is the discharge pressure Pd. That is, the first monitoring point P1 may be in the discharge chamber 22, in the condenser 31 or in the high pressure pipe 36. Similarly, the second pressure monitoring point P2 need not be located in the suction chamber 21 but may be at any location where the pressure is the suction pressure Ps. That is, the second monitoring point P2 may be in the suction chamber 21, in the evaporator 33 or in the low pressure pipe 35.

Figure 3:
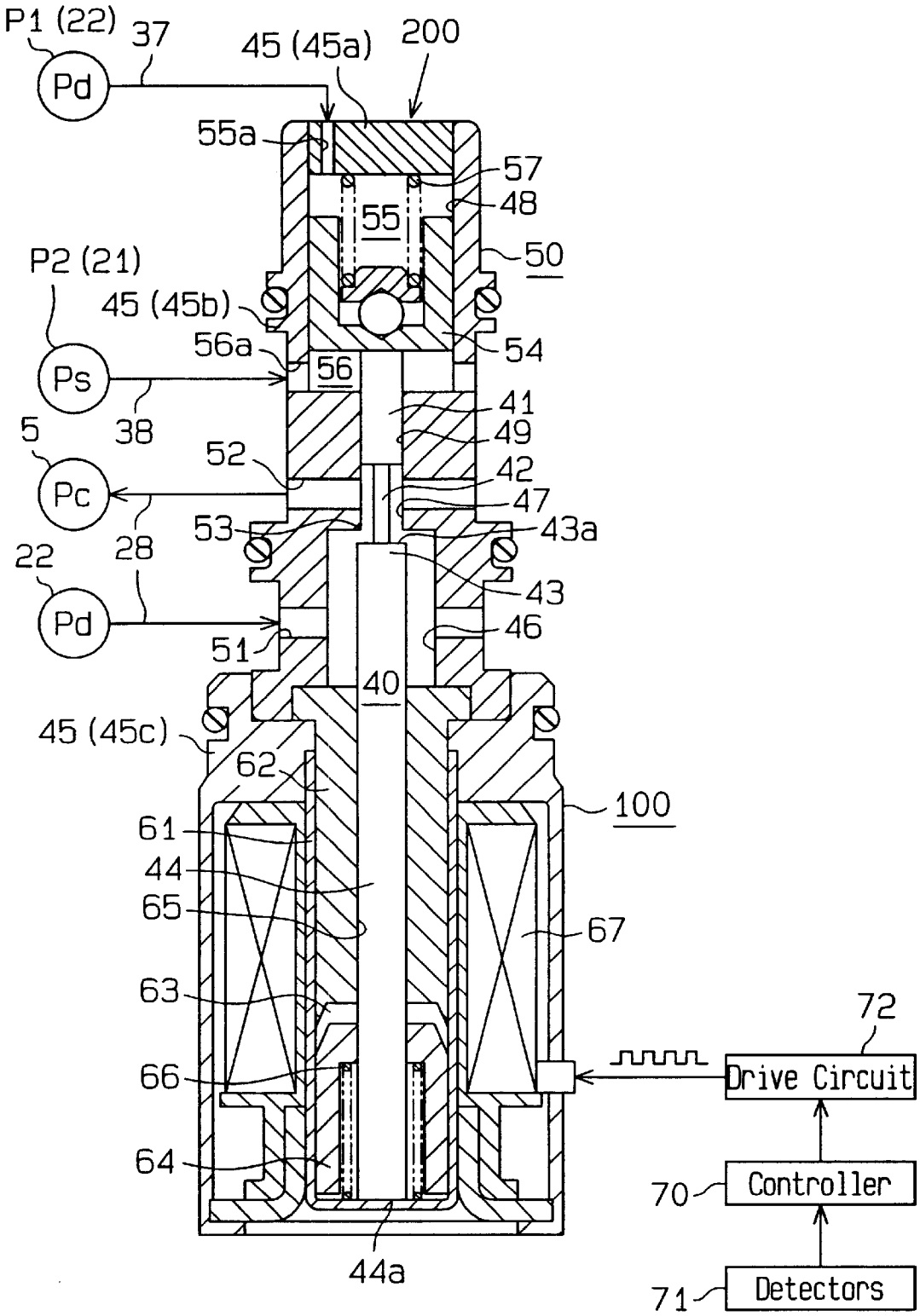
FIG. 3 is a cross-sectional view illustrating a control valve of FIG. 1.
Figure 4:
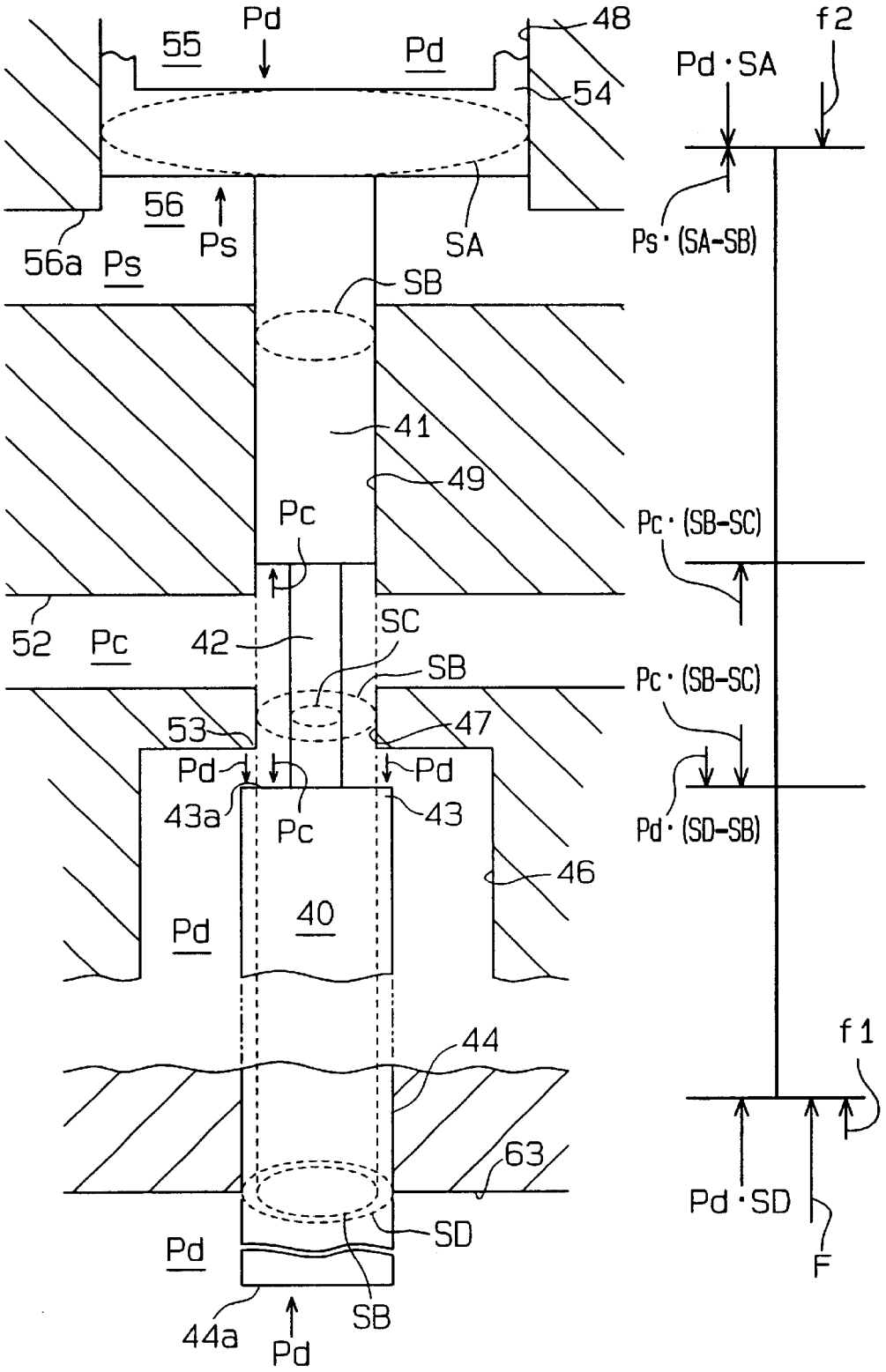
FIG. 4 is a schematic cross-sectional view showing part of the control valve shown in FIG. 3.

A control valve 200 shown in FIG. 3 is actuated by the pressure difference (Pd−Ps), which acts on the control valve 200. The control valve 200 includes an inlet valve mechanism 50 and an electromagnetic actuator, which is a solenoid 100 in this embodiment. The inlet valve mechanism 50 adjusts the opening size of the supply passage 28. The solenoid 100 applies a force that corresponds to the value of a supplied current to the inlet valve mechanism 50 through a rod 40, which has a circular cross section. The rod 40 includes a divider 41, a coupler 42 and a guide 44. A part of the guide 44 that is located adjacent to the coupler 42 functions as a valve body 43. As shown in FIG. 4, the cross-sectional area SB of the divider 41 is greater than the cross-sectional area of the coupler 42. The cross-sectional area SD of the guide 44 and the valve body 43 is greater than the cross-sectional area SB of the divider 41.

As shown in FIG. 3 the control valve 200 has a valve housing 45. The housing 45 includes an upper housing member 45*b* and a lower housing member 45*c*. The upper housing member 45*b* defines the shape of the inlet valve mechanism 50. The lower housing member 45*c* defines the shape of the solenoid 100. A plug 45*a* is fitted to an upper opening of the upper housing member 45*b* to close the opening. A valve chamber 46 and a guide hole 49 are formed in the upper housing member 45*b*. A pressure sensing chamber 48 is defined by the upper housing member 45*b* and the plug 45*a*. The upper housing member 45*b* has a wall that separates the pressure sensing chamber 48 from the valve chamber 46. The guide hole 49 extends through the wall. Part of the guide hole 49 that opens to the valve chamber 46 functions as a valve hole 47.

The rod 40 extends through the valve chamber 46, the guide hole 49 and the pressure sensing chamber 48. The rod 40 moves axially to selectively connect and disconnect the valve chamber 43 with the valve hole 47. The diameter of the guide hole 49 is constant in the axial direction. The cross-sectional area SB of the guide hole 49 is equal to the cross-sectional area SB of the divider 41 of the rod 40. Therefore, the divider 41, which is located in the guide hole 49, separates the pressure sensing chamber 48 from the valve chamber 46. Hereinafter, the cross-sectional area of the guide hole 49 and the valve hole 47 will be referred to as SB, which also represents the cross-sectional are of the divider 41.

A radial port 51 is formed in the upper housing member 45*b* and is connected to the valve chamber 46. The valve chamber 46 is connected to the discharge chamber 22 through the port 51 and an upstream section of the supply passage 28. A radial port 52 is also formed in the upper housing member 45*b* and is connected with the valve hole 47. The valve hole 47 is connected to the crank chamber 5 through the port 52 and a downstream section of the supply passage 28. The ports 51, 52, the valve chamber 46 and the valve hole 47 form a part of the supply passage 28 that is in the control valve 200.

The valve body 43 is located in the valve chamber 46. The cross-sectional area SB of the valve hole 47 is greater than the cross-sectional area SC of the coupler 42 and is smaller than the cross-sectional area SD of the guide 44 (see FIG. 4). A step defined between the valve chamber 46 and the valve hole 47 functions as a valve seat 53 to receive the valve body 43. When the valve body 43 contacts the valve seat 53, the valve hole 47 is disconnected from the valve chamber 46. When the valve body 43 is separated from the valve seat 53 as shown in FIG. 3, the valve hole 47 is connected to the valve chamber 46.

A pressure receiver, which is a cup-shaped movable spool 54 in this embodiment, is located in the pressure sensing chamber 48 and moves axially. The spool 54 divides the pressure sensing chamber 48 into a high pressure chamber 55 and a low pressure chamber 56. The spool 54 does not permit gas to flow between the higher pressure chamber 55 and the low pressure chamber 56. The cross-sectional area SA of the bottom wall of the spool 54 is greater than the cross-sectional area SB of the divider 41 and the guide hole 49 (see FIG. 4).

The higher pressure chamber 55 is connected to the discharge chamber 22, in which the first pressure monitoring point P1 is located, through a port 55*a* formed in the plug 45*a* and a first pressure introduction passage 37. The low pressure chamber 56 is connected to the suction chamber 21, in which the second pressure monitoring point P2 is located, through a port 56*a* formed in the upper housing member 45*b* and a second pressure introduction passage 38. Therefore, the higher pressure chamber 55 is exposed the discharge pressure Pd and the low pressure chamber 56 is exposed to the suction pressure Ps. The upper and lower surfaces of the spool 54 receive the discharge pressure Pd and the suction pressure Ps, respectively. The distal end of the rod 40, which is located in the low pressure chamber 56, is fixed to the spool 54. The spool 54, the high pressure chamber 55 and the low pressure chamber 56 form a pressure difference detection mechanism. A return spring 57 is located in the high pressure chamber 55. The return spring 57 urges the spool 54 from the high pressure chamber 55 toward the low pressure chamber 56.

The solenoid 100 includes a cup-shaped cylinder 61, which is fixed in the lower housing member 45*c*. A stationary iron core 62 is fitted into an upper opening of the cylinder 61. The stationary core 62 forms part of the inner walls of the valve chamber 46 and defines a plunger chamber 63 in the cylinder 61. A plunger 64 is located in the plunger chamber 63. The plunger 64 is moved axially. The stationary core 62 has guide hole 65 through which the guide 44 extends. There is a space (not shown) between the guide hole 65 and the guide 44. The space communicates the valve chamber 46 with the plunger chamber 63. Thus, the plunger chamber 63 is exposed to the discharge pressure Pd, to which the valve chamber 46 is exposed.

The lower portion of the guide 44 extends into the plunger chamber 63. The plunger 64 is fixed to the lower portion of the guide 44. The plunger 64 integrally moves with the rod 40 in the axial direction. A buffer spring 66 is located in the plunger chamber 63 and urges the plunger 64 toward the stationary core 62.

A coil 67 is located about the stationary core 62 and a plunger 64. A controller 70 supplies electricity to the coil 67 through a drive circuit 72. The coil 67 generates an electromagnetic force F between the stationary core 62 and the plunger 64. The magnitude of the force F corresponds to the value of the supplied electricity. The force F urges the plunger 64 toward the stationary core 62, which moves the rod 40. Accordingly, the valve body 43 is moved toward the valve seat 53.

The force of the buffer spring 66 is weaker than the force of the return spring 57. Thus, when electricity is not supplied to the coil 67, the return spring 57 moves the plunger 64 and the rod 40 to an initial position shown in FIG. 3, which causes the valve body 43 to maximize the opening size of the valve hole 47.

Electricity applied to the coil 67 may be changed either by changing the value of the voltage. Alternatively, the electricity may be changed by duty control. In this embodiment, the electricity is duty controlled. A smaller duty ratio Dt of the voltage applied to the coil 67 represents a smaller electromagnetic force F. A smaller force F causes the valve body 43 to increase the opening size of the valve hole 47.

The opening size of the valve hole 47 by the valve body 43 is determined by the axial position of the rod 40. The axial position of the rod 40 is determined by various forces acting on the rod 40. The forces will be described with reference to FIGS. 3 and 4. Downward forces as viewed in FIGS. 3 and 4 move the valve body 43 from the valve seat 53 (a valve opening direction). Upward forces as viewed in FIGS. 3 and 4 move the valve body 43 toward the valve seat 53 (a valve closing direction).

Forces acting on the part of the rod 40 that is above the coupler 42, that is, the forces acting on the divider 41, will now be described. As shown in FIGS. 3 and 4, the divider 41 receives a downward force f2, which is applied by the return spring 57, through the spool 54. The spool 54 receives a downward force based on the pressure difference (Pd−Ps) between the discharge pressure Pd in the high pressure chamber 55 and the suction pressure Ps in the low pressure chamber 56. The downward force based on the pressure difference (Pd−Ps) acts on the divider 41. The area of the spool 54 that receives the discharge pressure Pd in the high pressure chamber 55 is equal to the cross-sectional area SA of the bottom wall of the spool 54. The area of the spool 54 that receives the suction pressure Ps in the low pressure chamber 56 is computed by subtracting the cross-sectional area SB of the divider 41 from the cross-sectional area SA. The divider 41 also receives an upward force based on the pressure in the valve hole 47, or the crank pressure Pc. The area of the divider 41 that receives the pressure in the valve hole 47 is computed by subtracting the cross-sectional area SC of the coupler 42 from the cross-sectional area SB of the divider 41. If downward forces are represented by positive values, the net force ΣF1 acting on the divider 41 is represented by an equation I.

$$\Sigma F1 = Pd \cdot SA - Ps(SA - SB) - Pc(SB - SC) + f2 \quad \text{Equation I}$$

The forces acting on the part of the rod 40 that is below the coupler 42, that is, the forces acting on the guide 44, will now be described. The guide 44 receives an upward force f1 of the buffer spring 66 and the upward electromagnetic force F, which acts on the plunger 64. As shown in FIG. 4, the upper end surface 43*a* of the valve body 43 is divided into an inner section and an outer section by an imaginary cylinder, which is shown by broken lines in FIG. 4. The imaginary cylinder corresponds to the wall defining the valve hole 47. The pressure receiving area of the inner section is represented by SB−SC, and the pressure receiving area of the outer section is represented by SD−SB. The inner section receives a downward force based on the pressure in the valve hole 47, or the crank pressure Pc. The outer section receives a downward force based on the discharge pressure Pd in the valve chamber 46.

As described above, the plunger chamber 63 is exposed to the discharge pressure Pd of the valve chamber 46. The upper surface and the lower surface of the plunger 64 have the same pressure receiving area. Therefore, the forces acting on the plunger 64, which are based on the discharge pressure Pd, are cancelled. The lower end surface 44*a* of the guide 44 receives an upward force based on the discharge pressure Pd. The pressure receiving area of the lower end surface 44*a* is equal to the cross-sectional area SD of the guide 44. If the upward forces are represented by positive values, the net force ΣF2 acting on the guide 44 is represented by the following equation II.

$$\Sigma F2 = Pd \cdot SD - Pd(SD - SB) - Pc(SB - SC) + F + f1 \quad \text{Equation II}$$

$$= Pd \cdot SB - Pc(SB - SC) + F + f1$$

In the process of simplifying equation II, −Pc·SD is canceled by +Pc·SD, and the term Pc·SB remains. Thus, the resultant of the downward and upward forces acting on the guide 44 based on the discharge pressure Pd is an upward force, and the magnitude of the resultant upward force is determined based only on the cross-sectional area SB of the valve hole 47. The area of the part of the guide 44 that effectively receives the discharge pressure Pd, in other words, the effective discharge pressure receiving area of the guide 44, is equal to the cross-sectional area SB of the valve hole 47 regardless of the cross-sectional area SD of the guide 44.

The axial position of the rod 40 is determined such that the force ΣF1 in the equation I and the force ΣF2 in the equation II are equal. When the force ΣF1 is equal to the force ΣF2 (ΣF1=ΣF2), the following equation III is satisfied.

$$Pd - Ps = (F + f1 - f2)/(SA - SB) \quad \text{Equation III}$$

In equation III, the electromagnetic force F is a variable parameter that changes in accordance with the power supplied to the coil 67. As apparent from equation III, the rod 40 changes the pressure difference (Pd−Ps) according to changes of the electromagnetic force F. In other words, the rod 40 moves according to the pressure difference (Pd−Ps), which acts on the rod 40, such that the pressure difference (Pd−Ps) seeks a target value TPD, which is determined by the electromagnetic force F.

The pressures that affect the axial position of the rod 40 are only the discharge pressure Pd and the suction pressure Ps. The force based on the crank pressure Pc does not influence the position of the rod 40. Therefore, the rod 40 is actuated by the pressure difference (Pd−Ps), the electromagnetic force F and the spring forces f1, f2.

As described above, the downward force f2 of the return spring 57 is greater than the upward force f1 of the buffer spring 66. Thus, when voltage is not applied to the coil 67, in other words, when the electromagnetic force F is zero, the rod 40 is moved to the initial position shown in FIG. 3, which maximizes the opening size of the valve hole 47 by the valve body 43. When the duty ratio Dt of the voltage applied to the coil 67 is minimum in a predetermined range, the resultant of the upward electromagnetic force F and the upward force f1 of the buffer spring 66 is greater than the downward force f2 of the return spring 57. The resultant of the upward electromagnetic force F and the upward force f1 of the buffer spring 66 acts against the resultant of the downward force f2 of the return spring 57 and the downward force based on the pressure difference (Pd−Ps). The rod 40 is actuated for satisfying equation III. As a result, the position of the valve body 43 relative to the valve seat 53, in other words, the opening size of the valve hole 47, is determined. The flow rate of refrigerant gas from the discharge chamber 22 to the crank chamber 5 through the supply passage 28 corresponds to the opening size of the valve hole 47. The crank pressure Pc is controlled accordingly.

When the electromagnetic force F is constant, the control valve 200 operates such that the pressure difference (Pd−Ps) seeks the target value TPD, which corresponds to the electromagnetic force F. When the electromagnetic force F is adjusted based on a command from the controller and the target pressure difference TPD is changed accordingly, the control valve 200 operates such that the pressure difference (Pd−Ps) seeks the new target value TPD.

Figure 5:
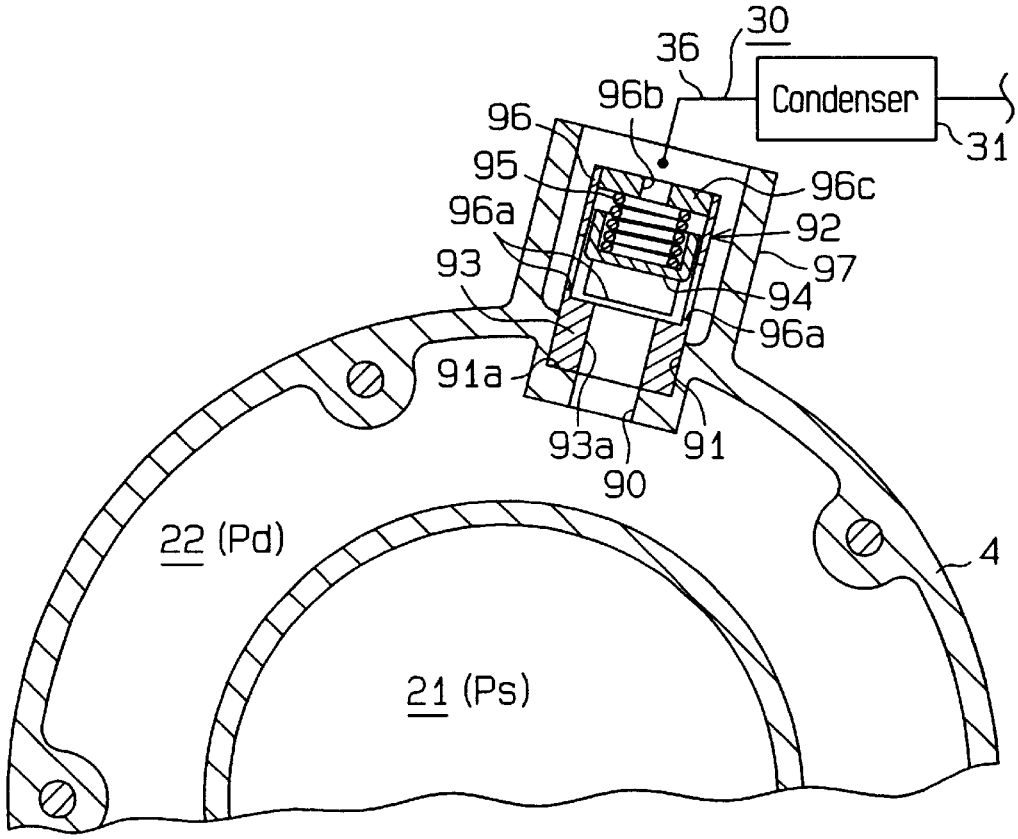
FIG. 5 is a cross-sectional view taken along line 5-5 of FIG. 1.
Figure 6:
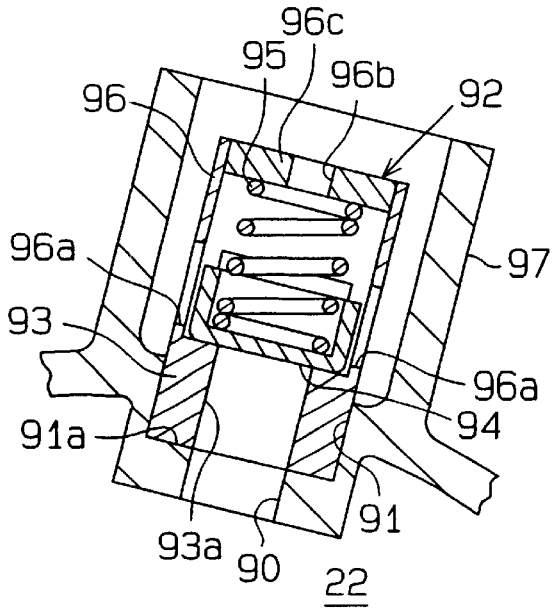
FIG. 6 is an enlarged partial cross-sectional view illustrating a check valve of FIG. 5.

As shown in FIGS. 1, 5 and 6, the discharge chamber is connected to the high pressure pipe 36 of the external circuit 30 by a discharge passage 90, which is formed in the rear housing member 4. A check valve 92 is located in the discharge passage 90. The check valve 92 and its mounting structure will be described below.

As shown in FIGS. 5 and 6, a valve pipe 97 for defining the discharge passage 90 protrudes from the periphery of the rear housing member 4. A seat 91 is formed in the middle of the discharge passage 90. The check valve 92 is press fitted in the seat 91. A step 91*a* is formed between the seat 91 and the inlet of the discharge passage 90 to determine the position of the check valve 92.

The check valve 92 includes a cylindrical case 96. The case 96 includes a valve seat 93. A valve hole 93*a* is formed in the valve seat 93. A valve seat 94 and a spring 95 are housed in the case 96. The spring 95 urges the valve body 94 toward the valve seat 93. When the case 96 is press fitted into the seat 91 and contacts the step 91*a*, the check valve 92 is located at the appropriate position in the discharge passage 90. Several through holes 96*a* are formed in the peripheral wall of the case 96. A plug 96*c* is fitted into an opening of the case 96 that is opposite to the valve hole 93*a*. The plug 96*c* receives the spring 95 and has a pressure introduction hole 96*b*. Thus, the valve body 94 is exposed to the discharge pressure Pd in the discharge chamber 22 through the valve hole 93*a*. The valve body 94 is also exposed to a pressure Pd' in the high pressure pipe 36 through the pressure introduction hole 96*b*. The valve body 94 selectively opens and closes the valve hole 93*a* in accordance with the difference between the pressures Pd and Pd'.

When the force based on the pressure difference (Pd−Pd') is greater than the force of the spring 95, the valve body 94 is separated from the valve seat 93 as shown in FIG. 5 and opens the valve hole 93*a*. Accordingly, refrigerant gas flows from the discharge chamber 22 to the high pressure pipe 36. When the force based on the pressure difference (Pd−Pd') is smaller than the force of the spring 95, the valve body 94 contacts the valve seat 93 as shown in FIG. 6 and closes the valve hole 93*a*. Accordingly, the discharge chamber 22 is disconnected from the high pressure pipe 36.

As shown in FIGS. 2 and 3, the controller 70 is a computer, which includes a CPU, a ROM, a RAM and an input-output interface. Detectors 71 detect various external information necessary for controlling the compressor and send the information to the controller 70. The controller 70 computes an appropriate duty ratio Dt based on the information and commands the drive circuit 72 to output a voltage having the computed duty ratio Dt. The drive circuit 72 outputs the instructed pulse voltage having the duty ratio Dt to the coil 67 of the control valve 200. The electromagnetic force F of the solenoid 100 is determined according to the duty ratio Dt.

The detectors 71 may include, for example, an air conditioner switch, a passenger compartment temperature sensor, a temperature adjuster for setting a desired temperature in the passenger compartment and a throttle sensor for detecting the opening size of a throttle valve of the engine E. The detectors 71 may also include a pedal position sensor for detecting the depression degree of the acceleration pedal of the vehicle. The opening size of the throttle valve and the depression degree of the acceleration pedal represent the load on the engine E.

Figure 7:
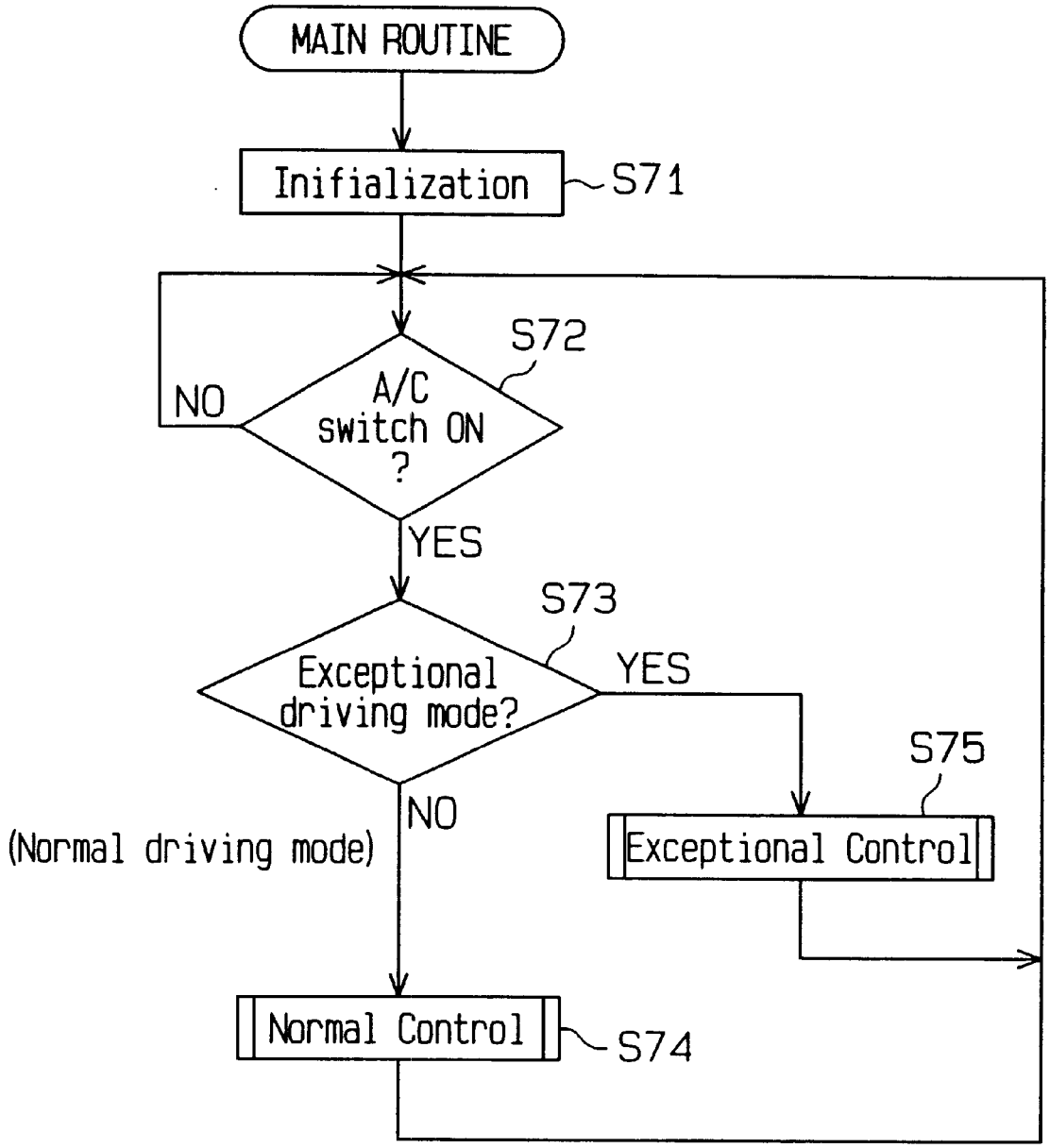
FIG. 7 is a flowchart showing a main routine for controlling a displacement.

The flowchart of FIG. 7 shows the main routine for controlling the compressor displacement. When the vehicle ignition switch or the starting switch is turned on, the controller 70 starts processing. The controller 70 performs various initial setting in step S71. For example, the controller 70 assigns a predetermined initial value to the duty ratio Dt of the voltage applied to the coil 67.

In step S72, the controller 70 waits until the air conditioner switch is turned on. When the air conditioner switch is turned on, the controller 70 moves to step S73. In step S73, the controller 70 judges whether the vehicle is in an exceptional driving mode. The exceptional driving mode refers to, for example, a case where the engine E is under high-load conditions such as when driving uphill or when accelerating rapidly. The controller 70 judges whether the vehicle is in the exceptional driving mode according to, for example, external information from the throttle sensor or the pedal position sensor.

Figure 8:
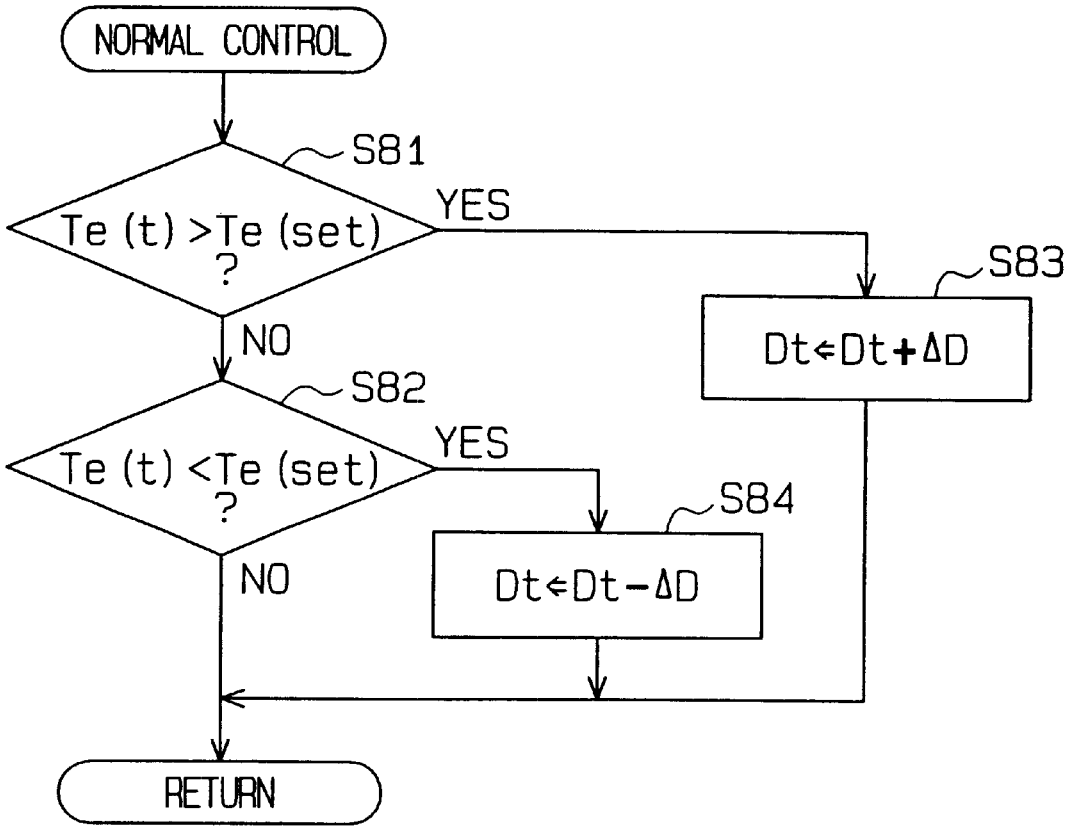
FIG. 8 is a flowchart showing a normal control procedure.
Figure 9:
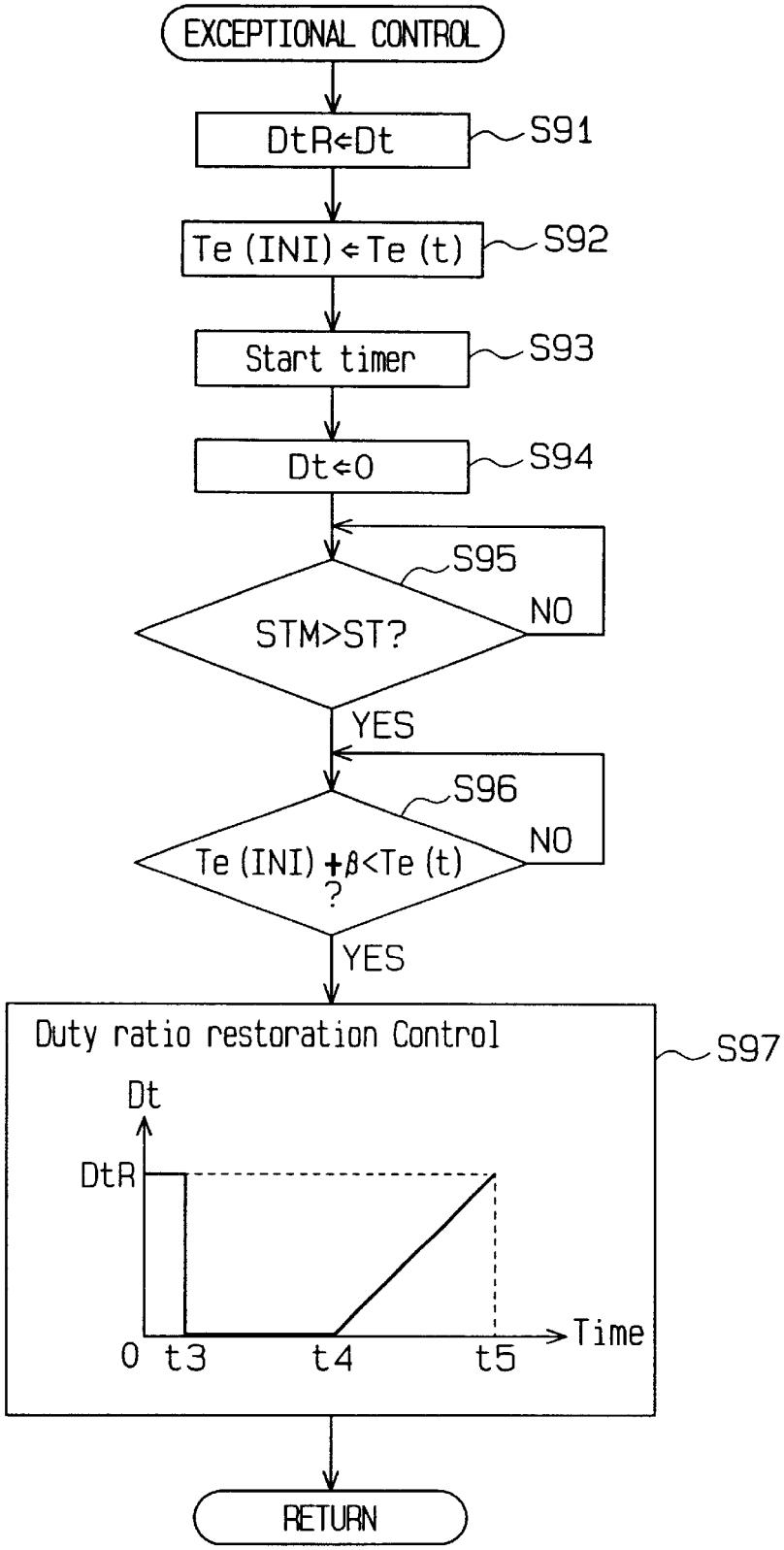
FIG. 9 is a flow chart showing an exceptional control procedure.

If the outcome of step S73 is negative, the controller 70 judges that the vehicle is in a normal driving mode and moves to step S74. The controller 70 then executes a normal control procedure shown in FIG. 8. If the outcome of step S73 is positive, the controller 70 executes an exceptional control procedure for temporarily limiting the compressor displacement in step S75. The exceptional control procedure differs according to the nature of the exceptional driving mode. FIG. 9 illustrates an example of the exceptional control procedure that is executed when the vehicle is rapidly accelerated.

The normal control procedure of FIG. 8 will now be described. In step S81, the controller 70 judges whether the temperature Te(t), which is detected by the temperature sensor, is higher than a desired temperature Te(set), which is set by the temperature adjuster. If the outcome of step S81 is negative, the controller 70 moves to step S82. In step S82, the controller 70 judges whether the temperature Te(t) is lower than the desired temperature Te(set). If the outcome in step S82 is also negative, the controller 70 judges that the detected temperature Te(t) is equal to the desired temperature Te(set) and returns to the main routine of FIG. 7 without changing the current duty ratio Dt.

If the outcome of step S81 is positive, the controller 70 moves to step S83 for increasing the cooling performance of the refrigerant circuit. In step S83, the controller 70 adds a predetermined value ΔD to the current duty ratio Dt and sets the resultant as a new duty ratio Dt. The controller 70 sends the new duty ratio Dt to the drive circuit 72. Accordingly, the electromagnetic force F of the solenoid 100 is increased by an amount that corresponds to the value ΔD, which moves the rod 40 in the valve closing direction. As the rod 40 moves, the force f2 of the return spring 57 is increased. The axial position of the rod 40 is determined such that equation III is satisfied.

As a result, the opening size of the control valve 200 is decreased and the crank pressure Pc is lowered. Thus, the inclination angle of the swash plate 12 and the compressor displacement are increased. An increase of the compressor displacement increases the flow rate of refrigerant in the refrigerant circuit and increases the cooling performance of the evaporator 33. Accordingly, the temperature Te(t) is lowered to the desired temperature Te(set) and the pressure difference (Pd−Ps) is increased.

If the outcome of S82 is positive, the controller 70 moves to step S84 for decreasing the cooling performance of the refrigerant circuit. In step S84, the controller 70 subtracts the predetermined value ΔD from the current duty ratio Dt and sets the resultant as a new duty ratio Dt. The controller 70 sends the new duty ratio Dt to the drive circuit 72. Accordingly, the electromagnetic force F of the solenoid 100 is decreased by an amount that corresponds to the value ΔD, which moves the rod 40 in the valve opening direction. As the rod 40 moves, the force f2 of the return spring 57 is decreased. The axial position of the rod 40 is determined such that equation III is satisfied.

As a result, the opening size of the control valve 200 is increased and the crank pressure Pc is raised. Thus, the inclination angle of the swash plate 12 and the compressor displacement are decreased. A decrease of the compressor displacement decreases the flow rate of refrigerant in the refrigerant circuit and decreases the heat reduction performance of the evaporator 33. Accordingly, the temperature Te(t) is raised to the desired temperature Te(set) and the pressure difference (Pd−Ps) is decreased.

As described above, the duty ratio Dt is optimized in steps S83 and S84 such that the detected temperature Te(t) seeks the desired temperature Te(set).

The exceptional control procedure of FIG. 9 will now be described. In step S91, the controller 70 stores the current duty ratio Dt as a restoration target value DtR. In step S92, the controller 70 stores the current detected temperature Te(t) as an initial temperature Te(INI), or the temperature when the displacement limiting control procedure is started.

In step S93, the controller 70 starts a timer. In step S94, the controller 70 changes the duty ratio Dt to zero percent and stops applying voltage to the coil 67. Accordingly, the opening size of the control valve 200 is maximized by the return spring 57, which increases the crank pressure Pc and minimizes the compressor displacement. As a result, the torque of the compressor is decreased, which reduces the load on the engine E when the vehicle is rapidly accelerated.

In step S95, the controller 70 judges whether the elapsed period STM measured by the timer is more than a predetermined period ST. Until the measured period STM surpasses the predetermined period ST, the controller 70 maintains the duty ratio Dt at zero percent. Therefore, the compressor displacement and torque are maintained at the minimum levels until the predetermined period ST elapses. The predetermined period ST starts when the displacement limiting control procedure is started. This permits the vehicle to be smoothly accelerated. Since acceleration is generally temporary, the period ST need not be long.

When the measured period STM surpasses the period ST, the controller 70 moves to step S96. In step S96, the controller 70 judges whether the current temperature Te(t) is higher than a value computed by adding a value β to the initial temperature Te(INI). If the outcome of step S96 is negative, the controller 70 judges that the compartment temperature is in an acceptable range and maintains the duty ratio Dt at zero percent. If the outcome of step S96 is positive, the controller 70 judges that the compartment temperature has increased above the acceptable range due to the displacement limiting control procedure. In this case, the controller 70 moves to step S97 and restores the cooling performance of the refrigerant circuit.

In step 597, the controller 70 executes a duty ratio restoration control procedure. In this procedure, the duty ratio Dt is gradually restored to the restoration target value DtR over a certain period. Therefore, the inclination of the swash plate 12 is changed gradually, which prevents the shock of a rapid change. In the chart of step S97, the period from time t3 to time t4 represents a period from when the duty ratio Dt is set to zero percent in step S94 to when the outcome of step S96 is judged to be positive. The duty ratio Dt is restored to the restoration target value DtR from zero percent over the period from the time t4 to time t5. When the duty ratio Dt reaches the restoration target value DtR, the controller 70 moves to the main routine shown in FIG. 7.

Figure 10A:
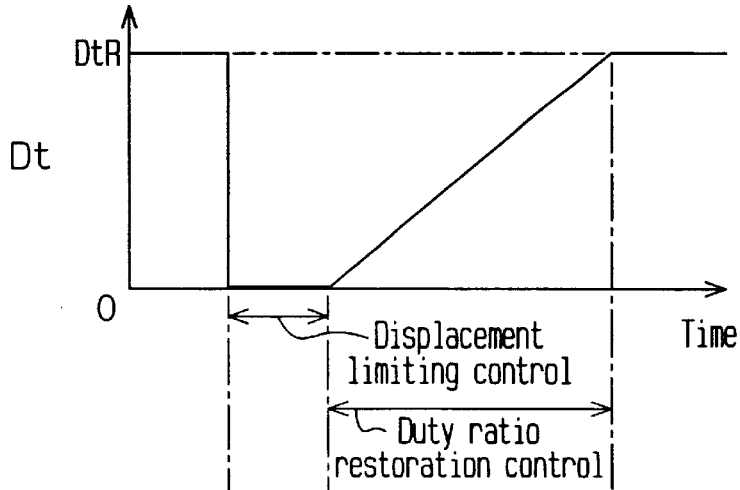
FIG. 10(*a*) is a timing chart showing changes of the duty ratio Dt of a voltage applied to a control valve during the exceptional control procedure.
Figure 10B:
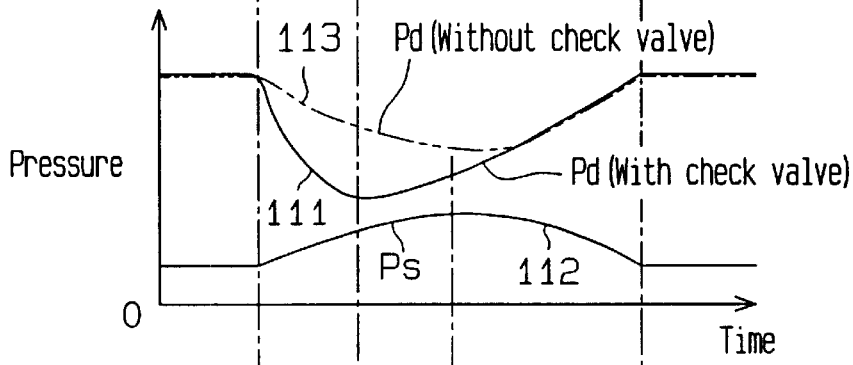
Figure 10C:
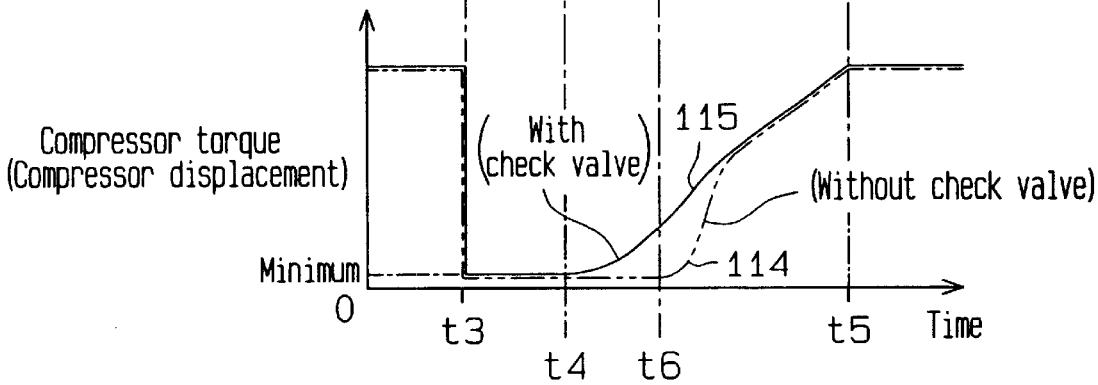

FIGS. 10(*a*) to 10(*c*) are timing charts showing changes of the duty ratio Dt, the discharge pressure Pd at the first pressure monitoring point P1, the suction pressure Ps at the second pressure monitoring point P2 and the compressor torque. When the duty ratio Dt is set to zero percent at time t3, the opening size of the control valve 200 is maximized. At the same time, the displacement and the torque of the compressor are minimized. Accordingly, the discharge pressure Pd is lowered as shown by solid line 111 in FIG. 10(*b*). Then, the check valve 92 disconnects the discharge chamber 22 from the high pressure pipe 36 to prevent back flow of highly pressurized gas from the high pressure pipe 36 to the discharge chamber 22. Therefore, the discharge pressure Pd is quickly lowered. Since the flow rate of gas from the suction chamber 21 to the cylinder bores 1*a* is decreased and gas flows to the crank chamber 5 to the suction chamber 21 through the bleed passage 27, the suction pressure Ps is increased as shown by solid line 112 in FIG. 10(*b*). As a result, the difference between the discharge pressure Pd and the suction pressure Ps is quickly decreased from time t3 to time t4, during which the compressor displacement is minimum. The check valve 92 functions as an accelerator that accelerates the reduction of the pressure difference (Pd−Ps).

The broken line 113 in FIG. 10(*b*) represents changes of the discharge pressure Pd at the first pressure monitoring point P1 when the check valve 92 is omitted. In this case, the discharge chamber 22 is constantly connected to the high pressure pipe 36. To lower the discharge pressure Pd at the first monitoring point P1, the gas pressure in a large zone that includes the discharge chamber 22 and the high pressure pipe 36 must be lowered. Thus as shown by broken line 113 in FIG. 10(*b*), the discharge pressure Pd is slowly decreased from time t3 to time t4. Therefore, the difference between the discharge pressure Pd and the suction pressure Ps is not sufficiently lowered. This means that there is an excessive discrepancy between the pressure difference (Pd−Ps) and the compressor displacement.

The control valve 200 shown in FIG. 3 operates to satisfy equation III for varying the compressor displacement. When the duty ratio Dt is zero percent, the electromagnetic force F of the solenoid 100 is eliminated. At this time the pressure difference (Pd−Ps) between the pressure monitoring points P1, P2 must satisfy equation IV. Equation IV is the same as equation III except that the electromagnetic force F is zero. As the difference between the force f1 of the buffer spring 66 and the force f2 of the return spring 57 is decreased, the target value of the pressure difference (Pd−Ps) when the duty ratio Dt is zero percent approaches zero.

$$Pd-Ps=(f1-f2)/(SA-SB) \qquad \text{Equation IV}$$

To quickly and accurately control the compressor displacement according to changes of the duty ratio Dt, the actual pressure difference (Pd−Ps), which acts on the valve body 54, must quickly and accurately respond to the target pressure difference TPD, which is changed by controlling the change of the duty ratio Dt. In the illustrated embodiment, the check valve 92 is located between the discharge chamber 22 and the high pressure pipe 36. Therefore, as shown by solid line 111 in FIG. 10(*b*), the discharge pressure Pd at the first monitoring point P1 is quickly lowered after time t3, at which the duty ratio Dt is set to zero percent, and the actual pressure difference (Pd−Ps) quickly seeks a value that satisfies equation IV. Thus, the actual pressure difference (Pd−Ps), which acts on the spool 54, greatly deviates from the target value TPD, which corresponds to the duty ratio Dt (zero percent), for a relatively short period. The period required for the actual pressure difference (Pd−Ps) to seek the target pressure difference TPD is in a permissible range (for example, from time t3 to time t4).

At time t4, a duty ratio restoration control procedure is started. Then, the opening size of the control valve 200 is gradually decreased such that the actual pressure difference (Pd−Ps) increases in accordance with the increase of the duty ratio Dt. As shown by solid line 115 in FIG. 10(*c*), the compressor displacement substantially accurately changes in accordance with the increase of the duty ratio Dt from time t4 to time t5, at which the duty ratio restoration control procedure is finished.

If the check valve 92 is omitted from the compressor of FIG. 1, the discharge pressure Pd at the first monitoring point P1 will change as shown by the broken line 113. That is, after time t3, at which the duty ratio Dt is set to zero percent, the discharge pressure Pd is slowly decreased and does not quickly seek a value that satisfies equation IV. At time t4, at which the duty ratio restoration control procedure is started, the actual pressure difference (Pd−Ps), which acts on the spool 54, differs greatly from the target pressure difference TPD, which corresponds to duty ratio Dt (zero percent).

The duty ratio Dt is gradually increased from time t4 to t5. However, the control valve 200 is fully opened after time t4 such that the actual pressure difference (Pd−Ps) is lowered to the target pressure difference TPD, which corresponds to the current duty ratio Dt. At time t6, the actual pressure difference (Pd−Ps) matches the target pressure difference TPD, which corresponds to the current duty ratio Dt. Although the duty ratio Dt is gradually increased during a period from time t4 to time t6, the control valve 200 is kept fully opened. Thus, as shown by the broken line 114 in FIG. 10(*c*), the compressor displacement is maintained at the minimum value during the period from time t4 to time t6. After time t6, the displacement and the torque of the compressor are suddenly increased due to a decrease of the opening size of the control valve 200, which produces a shock.

In this manner, if the check valve 92 is omitted, the displacement and the torque of the compressor are not gradually increased as shown by solid line 115 in FIG. 10(*c*) when the duty ratio Dt is changed from zero percent to the restoration target value DtR. The check valve 92 is very effective for changing the compressor displacement in accordance with changes of the duty ratio Dt.

This embodiment has the following advantages.

The control valve 200 does not directly control the suction pressure Ps, which is influenced by the thermal load on the evaporator 33. The control valve 200 directly controls the pressure difference (Pd−Ps) between the pressures at the pressure monitoring points P1, P2 in the refrigerant circuit for controlling the compressor displacement. Therefore, the compressor displacement is controlled regardless of the thermal load on the evaporator 33. During the exceptional control procedure, voltage is not applied to the control valve 200, which quickly minimizes the compressor displacement. Accordingly, during the exceptional control procedure, the displacement is limited and the engine load is decreased. The vehicle therefore runs smoothly.

During the normal control procedure, the duty ratio Dt is controlled based on the detected temperature Te(t) and the target temperature Te(set), and the rod 40 is actuated in accordance with the pressure difference (Pd−Ps). That is, the control valve 200 not only operates based on external commands but also automatically operates in accordance with the pressure difference (Pd−Ps), which acts on the control valve 200. The control valve 200 therefore effectively controls the compressor displacement such that the actual temperature Te(t) seeks the target temperature Te(set) and stably maintains the target temperature Te(set). Further, the control valve 200 quickly changes the compressor displacement when necessary.

The check valve 92 is located between the discharge chamber 22 and the high pressure pipe 36. The check valve 92 permits the compressor displacement to accurately respond to changes of the duty ratio Dt. Therefore, the compressor displacement is accurately controlled in a desired pattern by controlling the duty ratio Dt.

When the compressor displacement is minimum, the check valve 92 disconnects the discharge chamber 22 from the high pressure pipe 36. Therefore, when the compressor displacement is minimum, a gas circuit is formed within the compressor. The gas circuit includes the cylinder bores 1*a*, the discharge chamber 22, the supply passage 28, the crank chamber 5, the bleed passage 27 and the suction chamber 21. The refrigerant gas contains atomized oil. The oil is circulated in the gas circuit with the circulation of refrigerant gas and lubricates the moving parts of the compressor. Thus, when the air conditioner is not operating, the moving parts in the compressor are lubricated.

Figure 11:
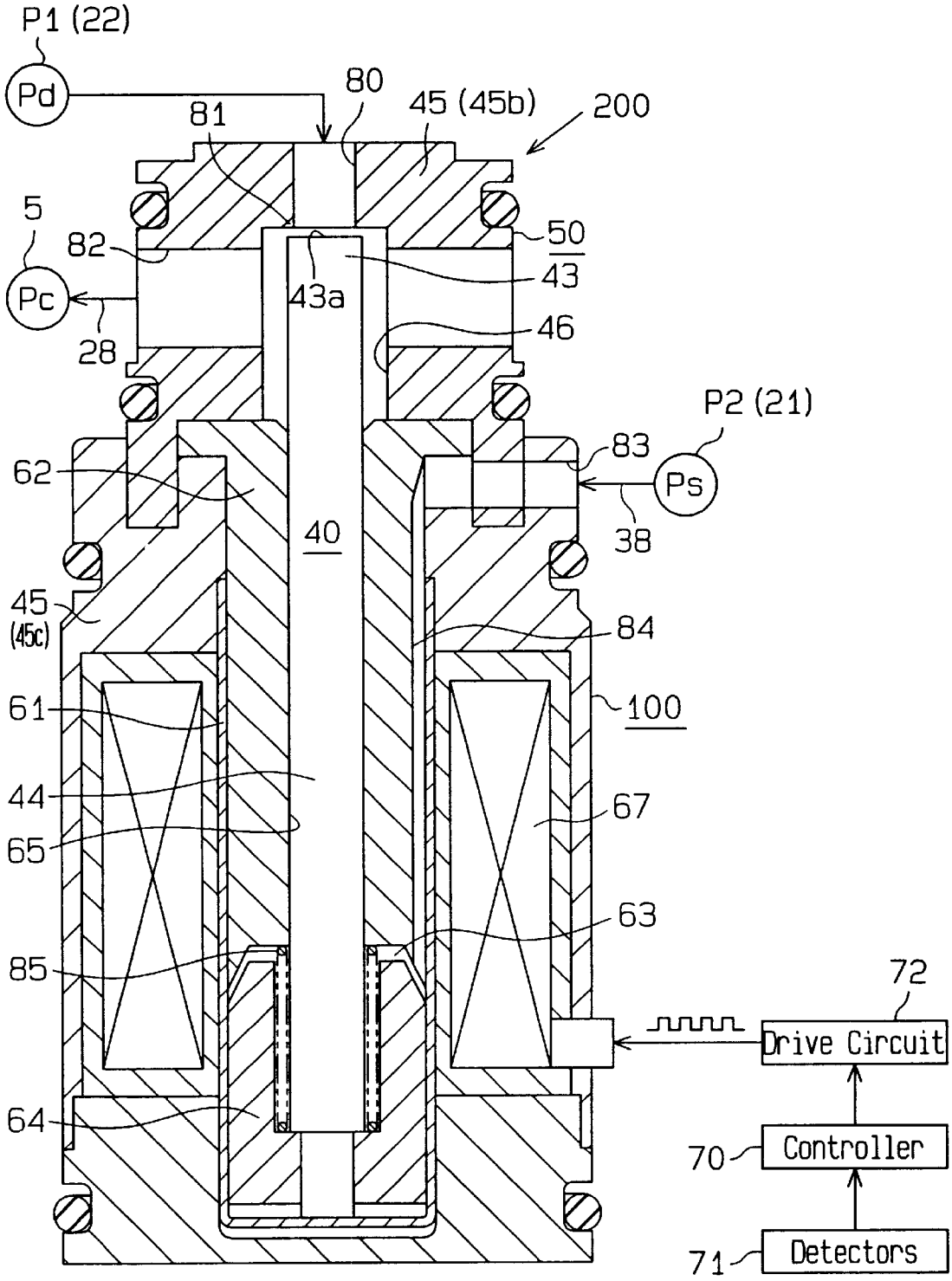
FIG. 11 is a cross-sectional view illustrating a control valve according to a second embodiment of the present invention.
Figure 12:
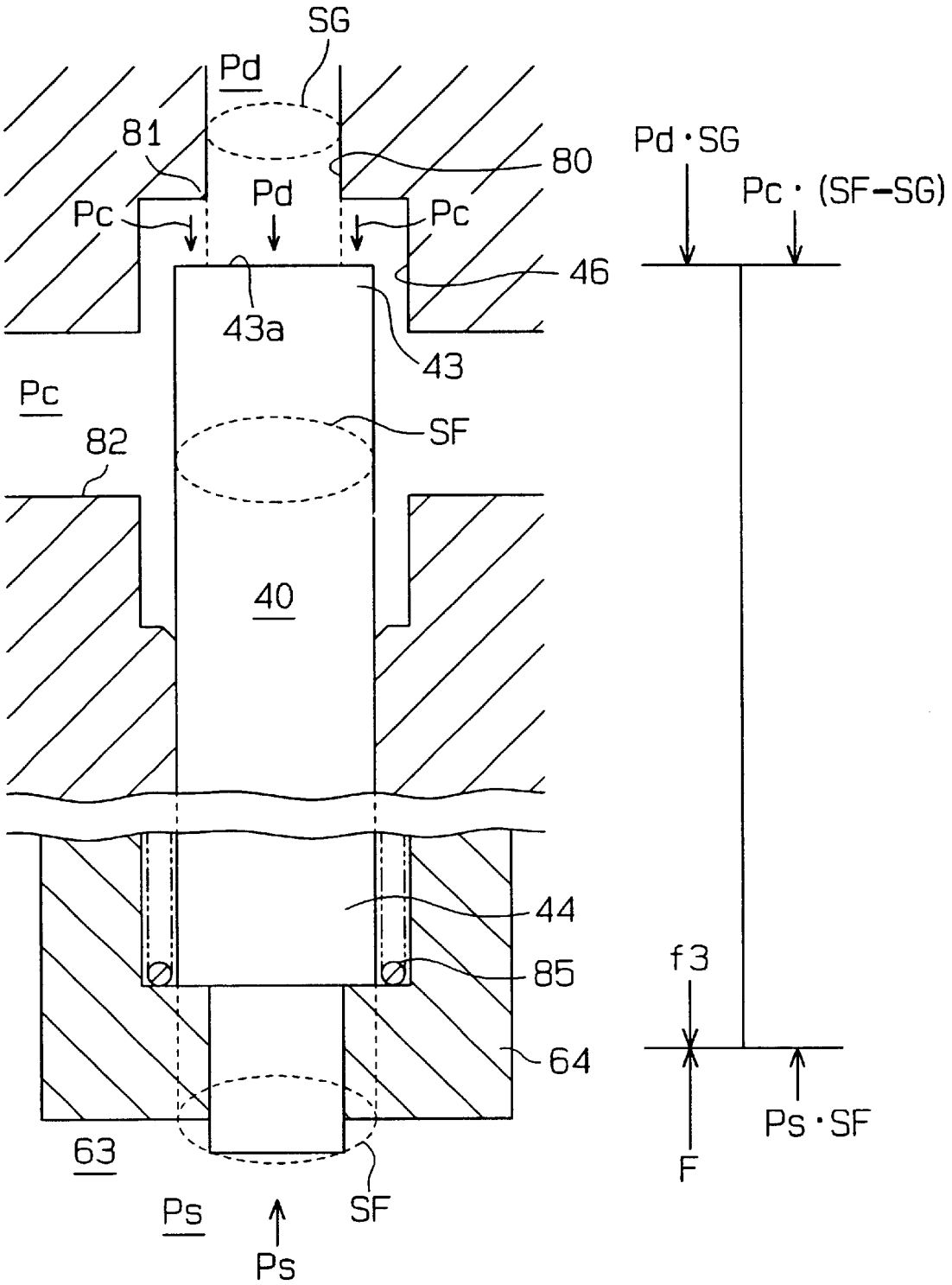
FIG. 12 is a schematic cross-sectional view showing part of the control valve shown in FIG. 1.

A second embodiment of the present invention will now be described with reference to FIGS. 11 and 12. The second embodiment is different from the embodiment of FIGS. 1 to 10(*c*) in the structure of the control valve 200 and in that the first pressure introduction passage 37 is omitted. In the second embodiment, an upstream section of the supply passage 28 functions as the first pressure introduction passage 37. Otherwise, the embodiment of FIGS. 11 and 12 is the same as the embodiment of the FIGS. 1 to 10(*c*). Like or the same reference numerals are given to those components that are like or the same as the corresponding components of the embodiment of FIGS. 1 to 10(*c*).

As shown in FIGS. 11 and 12, the rod 40 includes a guide 44. The valve body 43 is formed in the distal portion of the guide 44. The cross-sectional area of the guide 44 and the valve body 43 is represented by SF.

The housing member 45*b* includes an upper port 80. The upper port 80 is communicated with the valve chamber 46 and faces the valve body 43. The valve chamber 46 is connected to the discharge chamber 22 by the upper port 80 and an upstream section of the supply passage 28. The cross-sectional area SG of the upper port 80 is smaller than the cross-sectional area SF of the valve body 43. A step defined between the valve chamber 46 and the upper port 80 functions as a valve seat 81. The upper port 80 functions as a valve hole. When the valve body 43 contacts the valve seat 81, the upper port 80 is disconnected from the valve chamber 46.

A radial center port 82 is formed in the upper housing member 45*b* and is communicated with the valve chamber 46. The valve chamber 46 is connected to the crank chamber 5 through the center port 82 and a downstream section of the supply passage 28. The valve body 43 adjusts the opening size of the supply passage 28 according to the axial position of the rod 40.

The lower housing member 45*c* defines the shape of the lower portion of the solenoid 100. A radial lower port 83 is formed in the lower housing member 45*c*. The lower port 83 is connected to the suction chamber 21 through the second pressure introduction passage 38. The stationary iron core 62 includes an axial slit 84. The slit 84 defines a passage that connects the lower port 83 to the plunger chamber 63 between the inner wall of the cylinder 61 and the stationary core 62. The plunger chamber 63 is therefore exposed to the suction pressure Ps.

The end surface 43*a* of the valve body 43 receives the discharge chamber Pd in the upper port 80 and a crank pressure Pc in the valve chamber 46. The guide 44 and the plunger 64 receive the suction chamber Ps in the plunger chamber 63. There is no space between the guide 44 and the inner wall of a guide hole 65 formed in the stationary core 62. Therefore, the valve chamber 46 is disconnected from the plunger chamber 63. Unlike the control valve 200 in FIG. 3, the control valve of FIGS. 11 and 12 has no spool 54. The rod 40 functions as a pressure receiver.

A return spring 85 is located in the plunger chamber 63. The return spring 85 urges the plunger 64 away from the stationary iron core 62. When electricity is not supplied to the coil 67, the return spring 85 moves the plunger 64 and the rod 40 to an initial position shown in FIG. 11, which causes the valve body 43 to maximize the opening size of the upper port 80.

Axial forces acting on the rod 40 will now be described with reference to FIG. 12. The upper end surface 43*a* of the valve body 43 is divided into an inner section and an outer section by an imaginary cylinder, which is shown by broken lines in FIG. 12. The imaginary cylinder corresponds to the wall defining the upper port 80. The pressure receiving area of the inner section is represented by SG, and the pressure receiving area of the outer section is represented by SF−SG. The inner section receives a downward force based on the discharge pressure Pd in the upper port 80. The outer section receives a downward force based on the crank pressure Pc in the valve chamber 46.

The guide 44 receives a downward force f3 of the buffer spring 85 and an upward electromagnetic force F, which acts on the plunger 64. The suction pressure Ps in the plunger chamber 63 urges the guide 44 and the plunger 64 upward. An effective pressure receiving area of the guide 44 and the plunger 64 that receives the suction pressure Ps in the plunger chamber 63 is equal to the cross-sectional area SF of the guide 44.

The axial position of the rod 40 is determined such that the sum of the forces is zero. When the sum is zero, the following equation V is satisfied. In equation V, downward forces have positive values.

$$Pd \cdot SG + Pc(SF-SG) + f3 - Ps \cdot SF - F = 0 \qquad \text{Equation V}$$

Equation V can be modified to form the following equation VI.

$$(Pd-Ps)SG + (Pc-Ps)(SF-SG) = F - f3 \qquad \text{Equation VI}$$

In equation VI, the pressure difference (Pc−Ps) is negligible compared to the pressure difference (Pd−Ps). The area (SF−SG) is negligible compared to the area SG. If the pressure difference (Pc−Ps) and the area (SF−SG) are zero, the following equation VII is satisfied.

$$Pd-Ps \approx (F-f3)/SG \qquad \text{Equation VII}$$

As apparent from equation VII, the rod 40 changes the pressure difference (Pd−Ps) according to changes of the electromagnetic force F. In other words, the rod 40 moves according to the pressure difference (Pd−Ps), which acts on the rod 40, such that the pressure difference (Pd−Ps) seeks a target value TPD, which is determined by the electromagnetic force F. The pressures that affect the axial position of the rod 40 are only the discharge pressure Pd and the suction pressure Ps. The force based on the crank pressure Pc does not influence the position of the rod 40. Therefore, the rod 40 is actuated by the pressure difference (Pd−Ps), the electromagnetic force F and the spring forces f3.

Although the control valve 200 of FIGS. 11 and 12 has no spool 54, the control valve 200 operates in the same manner as the control valve 200 of FIG. 3. The control valve 200 of FIGS. 11 and 12 is therefore simple and compact.

In the control valve 200 of FIGS. 11 and 12, the diameter of the upper port 80 may be equal to the diameter of the valve body 43. In this case, the supply passage 28 is closed when the valve body 43 enters the upper port 80. The cross-sectional area SG of the upper port 80 is equal to the cross-sectional area SF of the valve body 43. Thus, the area SG can be replaced by the area SF in equation V, which satisfies the following equation VIII.

$$Pd \cdot SF + f3 - Ps \cdot SF - F = 0 \qquad \text{Equation VIII}$$

Equation V can be modified to form the following equation IX.

$$Pd-Ps = (F-f3)/SF \qquad \text{Equation IX}$$

Therefore, if the diameter of the upper port 80 is equal to the diameter of the valve body 43, the control valve operates in the same manner as the control valve of FIGS. 11 and 12. That is, the rod 40 moves according to the pressure difference (Pd−Ps) such that the pressure difference (Pd−Ps) seeks a target value TPD, which is determined by the electromagnetic force F. The force based on the crank pressure Pc does not influence the position of the rod 40 and the rod 40 is actuated by the pressure difference (Pd−Ps), the electromagnetic force F and the spring forces f3.

It should be apparent to those skilled in the art that the present invention may be embodied in many other specific forms without departing from the spirit or scope of the invention. Particularly, it should be understood that the invention may be embodied in the following forms.

Figure 13:
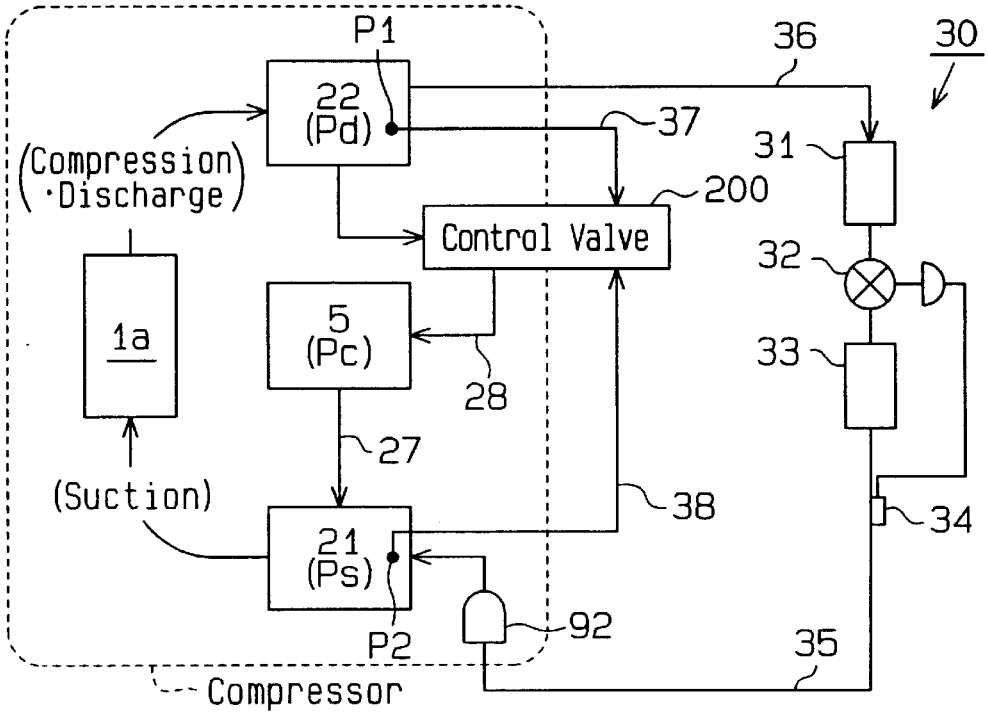
FIG. 13 is a schematic diagram illustrating a refrigerant circuit according a third embodiment of the present invention.
Figure 15A:
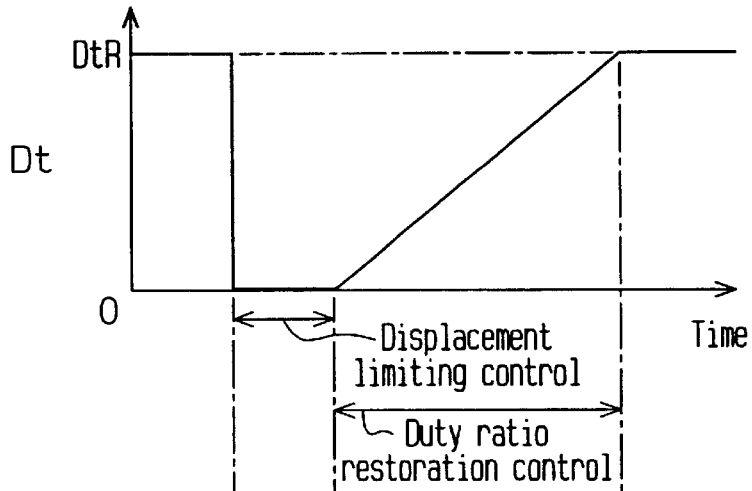
FIG. 15(*a*) is a timing chart showing changes of the duty ratio Dt of a voltage applied to a control valve during the exceptional control procedure.
Figure 15B:
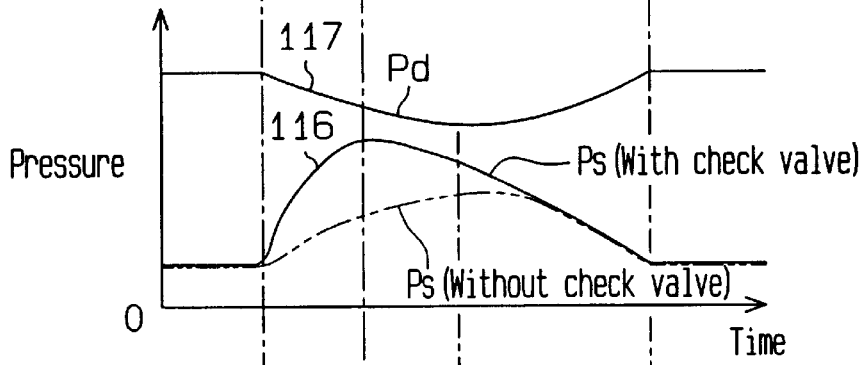
Figure 15C:
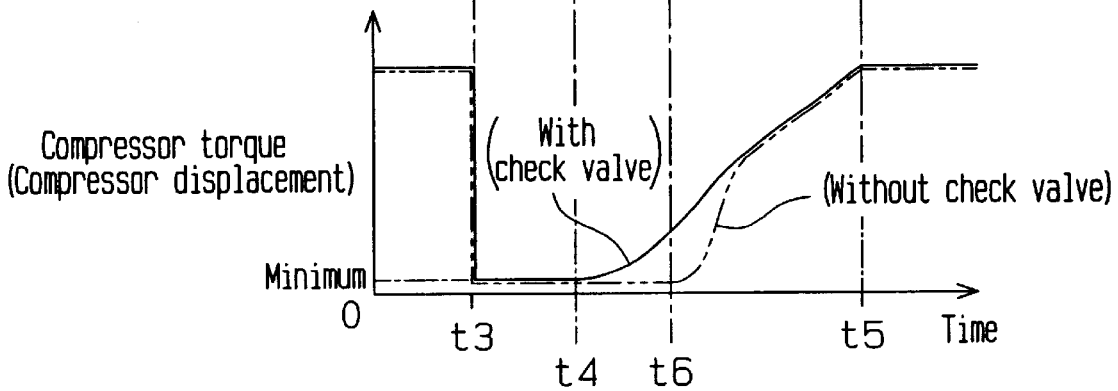

FIGS. 13 and 15(*c*) show a third embodiment. A check valve 92 is located between the suction chamber 21 and the low pressure pipe 35. The suction chamber 21 is connected to the low pressure pipe 35 through a suction passage 190 formed in the rear housing member 4. A step 191*a* and a seat 191 are formed at the outlet of the suction passage 190. The check valve 92 is press fitted in the seat 191. The step 191*a* determines the axial position of the check valve 92.

The structure of the check valve 92 is the same as that of FIG. 5. A valve body 94 receives a pressure Ps' in the low pressure pipe 35 from a valve hole 93*a* and the suction pressure Ps in the suction chamber 21 through a pressure introduction hole 96*b*. The valve body 94 selectively opens and closes the valve hole 93*a* in accordance with the difference between the pressures Ps' and Ps.

Figure 14:
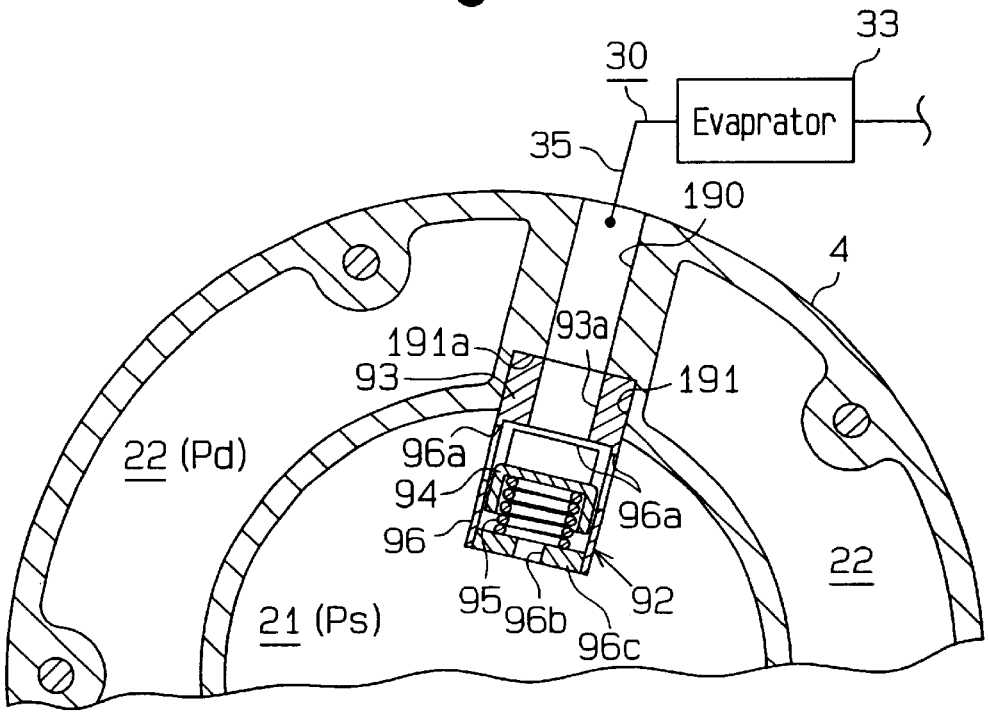
FIG. 14 is an enlarged partial cross-sectional view illustrating a check valve in the compressor of FIG. 13.

When the force based on the pressure difference (Ps'−Ps) is greater than the force of a spring 95, which acts on the valve body 94, the valve body 94 is separated from a valve seat 93 and opens the valve hole 93*a* as shown in FIG. 14. This permits refrigerant gas to flow from the low pressure pipe 35 to the suction chamber 21. When the force based on the pressure difference (Ps'−Ps) is smaller than the force of the spring 95, the valve body 94 contacts the valve seat 93 and closes the valve hole 93*a*, which disconnects the low pressure pipe 35 from the suction chamber 21. Accordingly, gas circulation in the refrigerant circuit is stopped. When the compressor displacement is minimum, the check valve 92 is closed.

In the embodiment of FIGS. 13 and 14, refrigerant gas discharged from the discharge chamber 22 is not supplied to the high pressure pipe 36 when the check valve 92 is closed. In this state, refrigerant gas circulates within the compressor.

Timing charts of FIGS. 15(*a*) to 15(*c*) correspond to those of FIGS. 10(*a*) to 10(*c*). When the duty ratio Dt is set to zero percent at time t3, the opening size of the control valve 200 is maximized. At the same time, the displacement and the torque of the compressor are minimized. Accordingly, the discharge pressure Pd is lowered as shown by solid line 117 in FIG. 15(*b*). Also, the flow rate of refrigerant in the refrigerant circuit is decreased and the pressure Ps' in the low pressure pipe 35 is lowered. Then, the check valve 92 disconnects the low pressure pipe 35 from the suction chamber 21 to prevent back flow of refrigerant gas from the suction chamber 21 to the low pressure pipe 35. Refrigerant gas constantly flows from the crank chamber 5 to the suction chamber 21 through the bleed passage 27. Therefore, as shown by solid line 116 in FIG. 15(*b*), the suction pressure Ps is quickly increased. As a result, the difference between the discharge pressure Pd an the suction pressure Ps is quickly decreased from time t3 to time t4, during which the compressor displacement is minimum.

In the embodiment of FIGS. 13 to 15(*c*), the actual pressure difference (Pd−Ps) quickly and accurately responds to changes of the duty ratio Dt. Therefore, the compressor displacement accurately responds to changes of the duty ratio Dt, which permits the compressor displacement to be accurately controlled along a desired pattern by controlling the duty ratio Dt.

Figure 16:
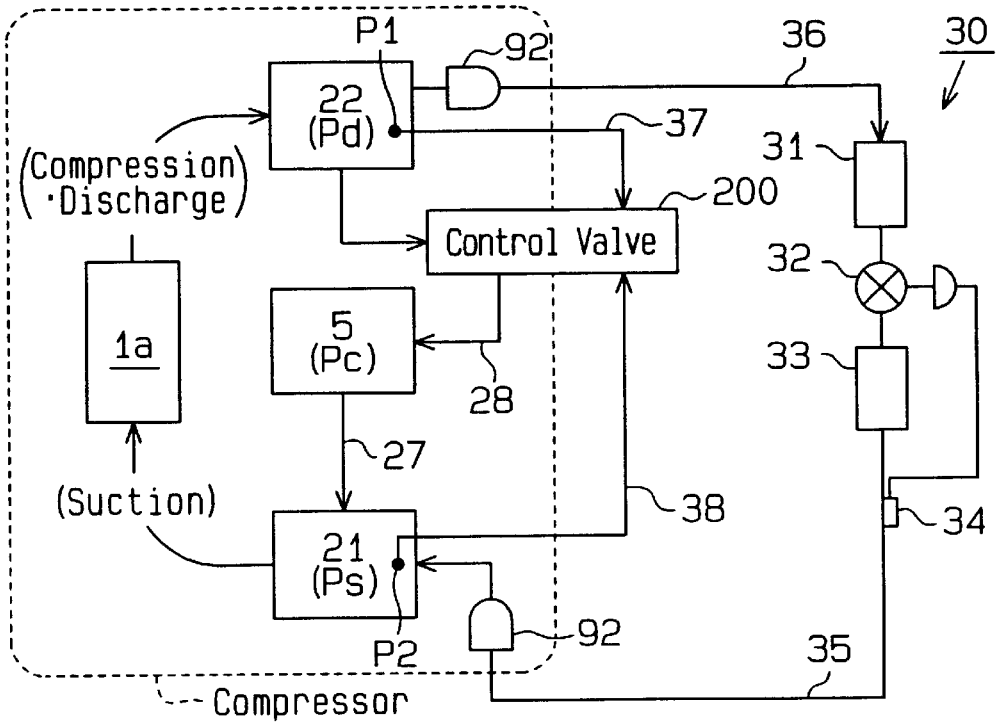
FIG. 16 is a schematic diagram illustrating a refrigerant circuit according a fourth embodiment of the present invention.
Figure 17:
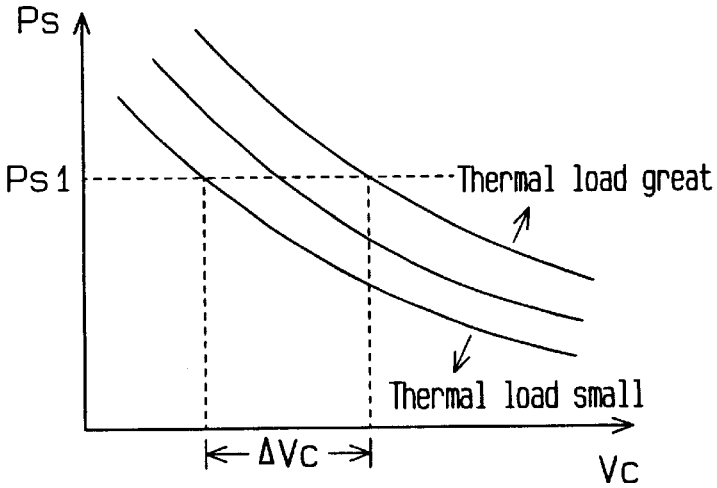
Fig.17 (Prior Art)
FIG. 17 is a graph showing the relationship between the suction pressure Ps and the displacement Vc of a prior art compressor.

FIG. 16 illustrates a fourth embodiment of the present invention. A check valve 92 is located between the discharge chamber 22 and the high pressure pipe 36. Another check valve 92 is located between the suction chamber 21 and the low pressure pipe 35.

Instead of the supply passage 28, the bleed passage 27 may be regulated by the control valve. In this case, the flow rate of refrigerant gas from the crank chamber 5 to the suction chamber 21 is adjusted by the control valve.

The temperature-type expansion valve 32 may be replaced by a fixed restrictor.

Therefore, the present examples and embodiments are to be considered as illustrative and not restrictive and the invention is not to be limited to the details given herein, but may be modified within the scope and equivalence of the appended claims.

What is claimed is:

1. An air conditioner including a refrigerant circuit, the refrigerant circuit having a condenser, a decompression device, an evaporator and a variable displacement compressor, wherein the compressor has a discharge pressure zone, the pressure of which is a discharge pressure, and a suction pressure zone, the pressure of which is a suction pressure, wherein the refrigerant circuit further has a high pressure passage extending from the discharge pressure zone to the condenser and a low pressure passage extending from the evaporator to the suction pressure zone, the air conditioner comprising:

a displacement control mechanism, which controls the displacement of the compressor based on the pressure difference between the pressure at a first pressure monitoring point located in the refrigerant circuit and the pressure at a second pressure monitoring point located in the refrigerant circuit, wherein the first pressure monitoring point is located in a section of the refrigerant circuit that includes the discharge pressure zone, the condenser and the high pressure passage, and wherein the second pressure monitoring point is located in a section of the refrigerant circuit that includes the evaporator, the suction pressure zone and the low pressure passage;

detectors for detecting external information used for controlling the compressor displacement other than the pressure difference; and a controller, which determines a target value of the pressure difference based on the detected external information, wherein the controller commands the target value to the displacement control mechanism, and wherein the displacement control mechanism controls the compressor displacement such that the actual pressure difference seeks the target value.

2. The air conditioner according to claim 1, wherein the first pressure monitoring point is located in the discharge pressure zone and the second pressure monitoring point is located in the suction pressure zone.

3. The air conditioner according to claim 1, wherein the compressor includes a crank chamber, an inclining drive plate located in the crank chamber and a piston, which is reciprocated by the drive plate, wherein the inclination angle of the drive plate changes in accordance with the pressure in the crank chamber, and the inclination angle of the drive plate determines the stroke of the piston and the compressor displacement, wherein the displacement control mechanism includes a control valve located in the compressor, and wherein the size of an opening of the control valve changes in accordance with the pressure difference, which acts on the control valve, for adjusting the pressure in the crank chamber.

4. The air conditioner according to claim 1, wherein the controller judges whether an exceptional control procedure is needed based on the detected external information, wherein, when judging that the exceptional control procedure is needed, the controller sets a target value of the pressure difference to a specific value.

5. The air conditioner according to claim 4, wherein the controller maintains the target value of the pressure difference at the specific value for a predetermined period and thereafter restores the target value to the target value that existed immediately before the exceptional control procedure was started in a predetermined restoration pattern.

6. The air conditioner according to claim 5, wherein the compressor is driven by an external drive source, and the detectors include a first detector for detecting external information representing the load acting on the external drive source and a second detector for detecting external information representing the required cooling performance of the refrigerant circuit, wherein the controller selects a control procedure from the exceptional control procedure and a normal control procedure based on the external information detected by the first detector, wherein, when the normal control procedure is selected, the controller determines the target value of the pressure difference based on the external information detected by the second detector.

7. The air conditioner according to claim 6, wherein the compressor is used in a vehicle, and the second detector includes a temperature sensor for detecting the temperature in the passenger compartment of the vehicle and a temperature adjuster for setting a target value of the compartment temperature, wherein, when the normal control procedure is selected, the controller determines the target value of the pressure difference based on the difference between the detected compartment temperature and the set target temperature.

8. The air conditioner according to claim 1, further comprising an accelerator, wherein, when the compressor displacement is decreased as the target value of the pressure difference is changed, the accelerator accelerates the decrease of the pressure difference.

9. The air conditioner according to claim 8 wherein the first pressure monitoring point is located in the discharge pressure zone, and wherein the accelerator includes a check valve located between the discharge pressure zone and the high pressure passage.

10. The air conditioner according to claim 8, wherein the second pressure monitoring point is located in the suction pressure zone, and wherein the accelerator includes a check valve located between the suction pressure zone and the low pressure passage.

11. A control valve for controlling the pressure in a crank chamber of a compressor to change the displacement of the compressor, wherein the compressor has a discharge pressure zone, the pressure of which is a discharge pressure, a suction pressure zone, the pressure of which is a suction pressure, and an internal gas passage that includes the discharge pressure zone, the crank chamber and the suction pressure zone, the control valve comprising:

a valve housing;

a valve body located in the valve housing, wherein the valve body adjusts the size of an opening in the internal gas passage;

a pressure receiver, wherein the pressure receiver actuates the valve body in accordance with the pressure difference between the discharge pressure and the suction pressure thereby causing the pressure difference to seek a predetermined target value; and an actuator for urging the valve body by a force, the magnitude of which corresponds to an external command, wherein the urging force of the actuator represents the target value of the pressure difference.

12. The control valve according to claim 11, wherein the valve housing defines a pressure sensing chamber, and the pressure receiver is located in the pressure sensing chamber to separate the pressure sensing chamber into a high pressure chamber and a low pressure chamber, and wherein the high pressure chamber is exposed to the discharge pressure from the discharge pressure zone, and the low pressure chamber is exposed to the suction pressure from the suction pressure zone.

13. The control valve according to claim 11, wherein the pressure receiver is a rod, which moves axially, the valve body being integral with the rod, and wherein the rod has an end surface that receives the discharge pressure and another end surface that receives the suction pressure.

14. The control valve according to claim 11, wherein the actuator is a solenoid that generates an urging force, the magnitude of which corresponds to the magnitude of a supplied current.

* * * * *

UNITED STATES PATENT AND TRADEMARK OFFICE

CERTIFICATE OF CORRECTION

PATENT NO. : 6,457,319 B1
DATED : October 1, 2002
INVENTOR(S) : Ota et al.

It is certified that error appears in the above-identified patent and that said Letters Patent is hereby corrected as shown below:

Column 7,
Line 12, please delete "cross-sectional are of" and insert therefore -- cross-sectional area of --;

Column 13,
Line 27, please delete "In step 597," and insert therefore -- In step S97 --;

Column 14,
Line 22, please delete "*Pd=Ps=(f*1*-f*2*)/(SA-SB)*" and insert therefore -- *Pd-Ps=(f*1*-f*2*)/(SA-SB)* --;

Column 18,
Line 56, please delete "Pd an the suction" and insert therefore -- Pd and the suction --;

Column 20,
Line 39, please delete "claim 8 wherein" and insert therefore -- claim 8, wherein --;

Signed and Sealed this

First Day of April, 2003

JAMES E. ROGAN
*Director of the United States Patent and Trademark Office*